US009659576B1

(12) United States Patent
Kotvis et al.

(10) Patent No.: US 9,659,576 B1
(45) Date of Patent: May 23, 2017

(54) BEAM FORMING AND ACOUSTIC ECHO CANCELLATION WITH MUTUAL ADAPTATION CONTROL

(71) Applicant: Biamp Systems Corporation, Beaverton, OR (US)

(72) Inventors: Matthew V. Kotvis, Portland, OR (US); Iain Alexander McCowan, Ashmore (AU); Ted S. Wada, Hillsboro, OR (US); Richard S. Juszkiewicz, Portland, OR (US); Nicholas W. Metzar, Beaverton, OR (US); Jeffrey William Sondermeyer, Beaverton, OR (US)

(73) Assignee: Biamp Systems Corporation, Beaverton, OR (US)

( * ) Notice: Subject to any disclaimer, the term of this patent is extended or adjusted under 35 U.S.C. 154(b) by 0 days.

(21) Appl. No.: 15/181,127

(22) Filed: Jun. 13, 2016

(51) Int. Cl.
*G10L 21/0364* (2013.01)
*G10L 21/0224* (2013.01)
(Continued)

(52) U.S. Cl.
CPC ..... *G10L 21/0364* (2013.01); *G10L 21/0224* (2013.01); *G10L 2021/02082* (2013.01); *G10L 2021/02166* (2013.01)

(58) Field of Classification Search
CPC ..... G10L 21/0364; G10L 21/0224; G10L 2021/02082; G10L 2021/02166
See application file for complete search history.

(56) References Cited

U.S. PATENT DOCUMENTS 6,990,193 B2 1/2006 Beaucoup et al.
7,630,503 B2 12/2009 Schulz et al.
(Continued)

OTHER PUBLICATIONS

Buchner, H. et al., "An Efficient Combination of Multi-Channel Acoustic Echo Cancellation with a Beamforming Microphone Array," International Workshop on Hands-Free Speech Communication (HSC2001), Kyoto, Japan, Apr. 9-11, 2001.
(Continued)

*Primary Examiner* — Sonia Gay
(74) *Attorney, Agent, or Firm* — DASCENZO Intellectual Property Law, P.C.

(57) ABSTRACT

Audio conferencing systems and methods with mutual adaptation control of adaptive beamforming and adaptive acoustic echo cancellation are disclosed. Mutual adaptation control may be achieved in a system including an adaptive beamforming module, an adaptive acoustic echo cancellation module, and an adaptation control module. The adaptive beamforming module has a controllable beamforming adaptivity and a beamforming adaptation state. The adaptive acoustic echo cancellation module has a controllable AEC adaptivity and an AEC adaptation state. The adaptation control module is configured and/or operates (i) to modify the beamforming adaptivity when the AEC adaptation state is unsettled (adapting to changed conditions), (ii) to modify the AEC adaptivity when the beamforming adaptation state is unsettled (adapting to changed conditions), (iii) to restore the beamforming adaptivity when the AEC adaptation state is settled, and (iv) to restore the AEC adaptivity when the beamforming adaptation state is settled.

20 Claims, 3 Drawing Sheets

(51) Int. Cl.

| | |
|---|---|
| ***G10L 21/028*** | (2013.01) |
| ***G10L 21/0216*** | (2013.01) |
| *G10L 21/0208* | (2013.01) |

(56) References Cited

U.S. PATENT DOCUMENTS

| | | | | |
|---|---|---|---|---|
| 7,831,035 | B2 | 11/2010 | Stokes et al. | |
| 7,970,123 | B2 | 6/2011 | Beaucoup | |
| 8,923,529 | B2 | 12/2014 | McCowan | |
| 9,001,994 | B1 * | 4/2015 | Yang | H04M 9/082 379/406.08 |
| 9,215,327 | B2 | 12/2015 | Bathurst et al. | |
| 9,232,072 | B2 | 1/2016 | Volcker | |
| 9,264,553 | B2 | 2/2016 | Pandey et al. | |
| 9,264,805 | B2 | 2/2016 | Buck et al. | |
| 2002/0015500 | A1 | 2/2002 | Belt et al. | |
| 2002/0041679 | A1 | 4/2002 | Beaucoup | |
| 2006/0233353 | A1 * | 10/2006 | Beaucoup | H04M 9/082 379/406.01 |
| 2013/0121498 | A1 * | 5/2013 | Giesbrecht | H04M 9/082 381/66 |

OTHER PUBLICATIONS

Herbordt, W. et al., "Joint Optimization of LCMV Beamforming and Acoustic Echo Cancellation," IEEE International Conference on Acoustics, Speech, and Signal Processing, Mar. 18-23, 2005.

Kellermann, W., "Strategies for Combining Acoustic Echo Cancellation and Adaptive Beamforming Microphone Arrays," IEEE International Conference on Acoustics, Speech, and Signal Processing. Apr. 21-27, 1997.

* cited by examiner

BEAM FORMING AND ACOUSTIC ECHO CANCELLATION WITH MUTUAL ADAPTATION CONTROL

FIELD

The present disclosure relates to audio conferencing systems, devices, and methods for beamforming and acoustic echo cancellation with mutual adaptation control.

BACKGROUND

In audio conferencing between different sites, conference participants (also called talkers) at different sites communicate with each other by sending audio signals between the sites. Each site has a microphone to receive sound from that site and each site transmits the received audio signal to the other site(s). Each site also receives audio signals from the other site(s) and has a loudspeaker to generate sound from the received audio signal. As used herein, a loudspeaker is an audio output device (an electromechanical device), not a person speaking. At a local site (also called a near end), the remote audio signal, sent by a remote site (also called a far end) is rendered by the loudspeaker. The rendered remote audio signal may be picked up by the microphone at the local site and be retransmitted back to the remote site. The echo and other sound distortions present at the local site and the signal transmission between sites may result in a remote conference participant hearing his/her own voice return over the audio conferencing system. This echo degrades the audio quality of the conference and leads to participant dissatisfaction.

To reduce the effects of return echo, audio conferencing systems typically apply acoustic echo cancelling techniques. In acoustic echo cancellation (AEC), one filters the incoming audio signals from the local microphone(s) to reduce the influence of sound rendered by the local loudspeakers. Acoustic echo cancellation estimates and substantially attenuates the effects of the remote audio signal. Acoustic echo cancellation typically includes adaptive elements (which respond differently according to input conditions) to accommodate changing conditions such as different talkers and moving objects at the local site.

Audio conferencing systems also may employ beamforming and multiple microphones to capture the participants' voices. Beamforming (BF) uses a group of microphones, such as a microphone array, to improve voice acquisition as compared to use of a single microphone. The combination of several microphone audio signals may form a directed beam of audio sensitivity that is more directional and selective than any of the individual microphones. The audio signal thus combined (which may be called the beam audio signal) may have better noise rejection of noise sources outside of the beam than the individual audio signals from the individual microphones. Beamforming systems typically are adaptive in that the beamforming is responsive to the input. Hence, changing talkers, movement of participants, and changing noise sources may be accommodated.

Some audio conferencing systems are configured for both beamforming and acoustic echo cancellation. However, integrating the technologies may involve system performance trade-offs. The two primary approaches to integrating beamforming and acoustic echo cancellation are called 'AEC first' and 'beamforming first' according to the order of operations.

In an AEC-first approach, acoustic echo cancellation is performed on each of the plurality of input audio signals coming from the microphones (e.g., directly from the microphones). Beamforming is performed on the plurality of echo-cancelled audio signals output from the plurality of acoustic echo cancellation operations. This approach has the benefit that each acoustic echo cancellation operation is performed on an audio signal from a fixed beam or microphone and, hence, the acoustic echo cancellation performance for each input is similar to that performed with a single input system. However, as the number of input audio signals increases, the computing resource demand becomes likewise great. Wth large numbers of audio inputs (i.e., greater than a few, e.g., 5), the computing resource demand may be impractically large.

In a beamforming-first approach, beamforming is performed on the plurality of input audio signals coming from the microphones to generate a single or a few beamformed audio signals. Acoustic echo cancellation is then performed on the beamformed audio signals, either individually or following a beam combination or mixing stage. This approach has the advantage that the computing resource demand does not significantly change according to the number of audio inputs. However, because the beamformer may change the direction and/or gain of the signal in the resulting beamformed audio signal, the acoustic echo cancellation operation may need to adapt to changing conditions (e.g., different echo paths) more often and more acutely than if a beamformer were not used.

Many audio conferencing systems are implemented with a beamforming-first approach and consequently suffer from the potential destabilization of acoustic echo cancellation due to changes driven by beamforming (rather than primarily by talkers). Hence, there is a need for systems and methods of combined beamforming and acoustic echo cancellation which overcome the limitations of prior systems.

SUMMARY

Audio conferencing systems and methods with mutual adaptation control of adaptive beamforming and adaptive acoustic echo cancellation are disclosed. Mutual adaptation control may be achieved in a system including an adaptive beamforming module, an adaptive acoustic echo cancellation module, and an adaptation control module. The adaptive beamforming module has a controllable beamforming adaptivity and a beamforming adaptation state. The adaptive acoustic echo cancellation module has a controllable AEC adaptivity and an AEC adaptation state. The adaptation control module is configured and/or operates (i) to modify the beamforming adaptivity when the AEC adaptation state is unsettled (adapting to changed conditions), (ii) to modify the AEC adaptivity when the beamforming adaptation state is unsettled (adapting to changed conditions), (iii) to restore the beamforming adaptivity when the AEC adaptation state is settled, and (iv) to restore the AEC adaptivity when the beamforming adaptation state is settled.

In some embodiments, the adaptive beamforming module is configured to receive at least one beamforming adaptation parameter to control the beamforming adaptivity and is configured to provide at least one beamforming status indicator that indicates the beamforming adaptation state. The adaptive acoustic echo cancellation module is configured to receive at least one AEC adaptation parameter to control the AEC adaptivity and is configured to provide at least one AEC status indicator that indicates the AEC adaptation state. The adaptive beamforming module is configured to generate a beamformed audio signal based upon the beamforming adaptation parameter. The adaptive acoustic echo cancellation module is configured to generate an echo-cancelled audio signal based upon the AEC adaptation parameter.

In some embodiments, the audio conferencing system includes an adaptive beamforming module and an adaptive acoustic echo cancellation module. The adaptive beamforming module has a controllable beamforming adaptivity and a beamforming adaptation state. The adaptive acoustic echo cancellation module has a controllable AEC adaptivity and an AEC adaptation state. The adaptive beamforming module is configured to modify the beamforming adaptivity when the AEC adaptation state is unsettled and is configured to restore the beamforming adaptivity when the AEC adaptation state is settled. The adaptive acoustic echo cancellation module is configured to modify the AEC adaptivity when the beamforming adaptation state is unsettled and is configured to restore the AEC adaptivity when the beamforming adaptation state is settled.

In some embodiments, the method includes (i) receiving a first AEC status indicator from the adaptive acoustic echo cancellation module that indicates that the adaptive acoustic echo cancellation module is adapting to changed conditions (unsettled), (ii) determining a beamforming modified-adaptation parameter based upon the first AEC status indicator, and (iii) while the adaptive acoustic echo cancellation module is adapting to changed conditions as indicated by the first AEC status indicator, beamforming with the adaptive beamforming module based upon the beamforming modified-adaptation parameter. The method also includes (i) receiving a first beamforming status indicator from the adaptive beamforming module that indicates that the adaptive beamforming module is adapting to changed conditions (unsettled), (ii) determining an AEC modified-adaptation parameter based upon the first beamforming status indicator, and (iii) while the adaptive beamforming module is adapting to changed conditions as indicated by the first beamforming status indicator, echo-cancelling with the adaptive acoustic echo cancellation module based upon the AEC modified-adaptation parameter.

DESCRIPTION

Figure 1:
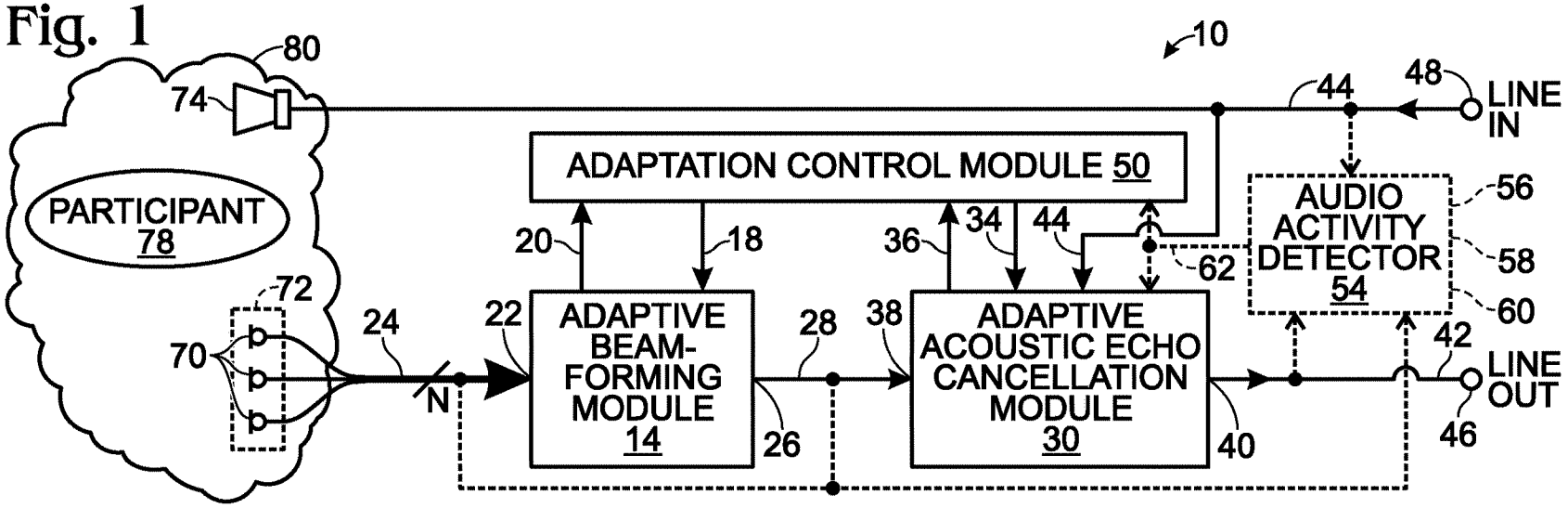
FIG. 1 is a schematic representation of an example of an audio conferencing system of the present disclosure.

The systems and methods of the present disclosure combine adaptive beamforming and adaptive acoustic echo cancellation in audio conferencing applications. Adaptive beamforming and adaptive acoustic echo cancellation are performed cooperatively. Generally, when one operation is adapting to changes in the audio signals, the adaptation of the other operation is restricted. For example, adaptation in beamforming may be paused while acoustic echo cancellation is adapting to a different remote talker or a different echo path. Similarly, adaptation in acoustic echo cancellation may be enhanced while beamforming is adapting to a different local talker or a different noise source. In this manner, a beamforming-first audio conferencing system may be produced that substantially or completely eliminates the beamforming destabilization effect on the acoustic echo cancellation operation.

In an audio conferencing system with an adaptive beamforming module and an adaptive acoustic echo cancellation module, the cooperation between the adaptive modules may be implemented by status indicators that are shared between the adaptive modules (directly or indirectly). The status indicators indicate whether the associated adaptive module is adapting to changed conditions (including presently changing conditions) or whether the associated adaptive module is relatively stable, having sufficiently adapted to the previous (changed) conditions. While adapting to changed conditions, the adaptive module may be described as in an unsettled state. While relatively stable, having sufficiently adapted to the changed conditions, the adaptive module may be described as in a settled state. The status indicators are not necessarily binary indicators and may indicate a range between a settled and unsettled state and/or may indicate different types of settled and/or unsettled states.

FIGS. 1-5 illustrate systems, devices, modules, and methods for beamforming and acoustic echo cancellation with mutual adaptation control. In general, in the drawings, elements that are likely to be included in a given embodiment are illustrated in solid lines, while elements that are optional or alternatives are illustrated in dashed lines. However, elements that are illustrated in solid lines are not essential to all embodiments of the present disclosure, and an element shown in solid lines may be omitted from a particular embodiment without departing from the scope of the present disclosure. Elements that serve a similar, or at least substantially similar, purpose are labelled with numbers consistent among the figures. Like numbers in each of the figures, and the corresponding elements, may not be discussed in detail herein with reference to each of the figures. Similarly, all elements may not be labelled or shown in each of the figures, but reference numerals associated therewith may be used for consistency. Elements, components, and/or features that are discussed with reference to one or more of the figures may be included in and/or used with any of the figures without departing from the scope of the present disclosure.

FIG. 1 illustrates an audio conferencing system 10 (which may be referred to as system 10). The audio conferencing system 10 is configured for communication between at least two sites 80 (a local site and a remote site, also called a near end and a far end respectively). In FIG. 1, one site 80 is illustrated with components that may be associated with that site 80. The audio conferencing system 10 may encompass some or all of the components associated with a single site 80. The audio conferencing system 10 at each site 80 has a line out 46 (configured to transmit a near-end audio signal 42 from that site) and a line in 48 (configured to receive a far-end audio signal 44 from other sites). Audio conferencing systems 10 at different sites 80 are connected such that the line out 46 of one site is functionally connected to the line in 48 of the other sites. Audio conferencing systems 10 may be connected to other audio conferencing systems 10 and/or to systems of other designs. In some embodiments, the audio conferencing system 10 encompasses some or all of the components associated with at least a local site 80 and a remote site 80. In some embodiments, the line out 46 and/or the line in 48 are connected to/from a remote site 80 via intermediary processing devices. For example, the line outs 46 of several audio conferencing systems 10 may be connected to an automixer e.g., an automatic gating mixer, which transmits a mixed line out to a remote site 80.

The audio conferencing system 10 is configured for communication with audio transmissions (signals transmitting audio information). The audio conferencing system 10 may be configured for communication with audio-video transmissions and may be called an audio-video conferencing system 10. Additionally or alternatively, audio conferencing system 10 may be configured to communicate other media and/or other data along with the audio and/or video transmissions.

At site 80, a participant 78 may communicate using the audio conferencing system 10. The participant 78 (also called a talker) is situated at the site 80, which also may be referred to as a reception space and/or a conference space. The audio conferencing system 10 may include a loudspeaker 74 at the site 80. The loudspeaker 74 is configured to render sound according to the far-end audio signal 44 into the site 80 so that the participant 78 may hear the sound.

The audio conferencing system 10 may include a plurality of microphones 70 at the site 80. The plurality of microphones 70 is configured to transmit a plurality of input audio signals 24 based upon the sound received at the microphones (e.g., from the participants 78). Each microphone 70 is a device to receive sound and produce an audio signal based upon the sound received.

Generally, each microphone 70 produces one of the input audio signals 24. Additionally or alternatively, audio signals from the microphones 70 may be combined to produce the input audio signal 24 (e.g., with a pre-processing mixer stage or other form of signal combination before the adaptive beamforming module 14). The combination of audio signals from the microphones 70 may reduce, increase, or maintain the total number of audio signals. Hence, the number of microphones 70 may be different than the number of input audio signals 24. Each microphone 70 and/or each input audio signal 24 may be selectively receptive to sound from a portion of the site 80. The portions of the site 80 (also referred to as zones of the site 80) may overlap or be separated. Generally, the group of all of the portions corresponding to all of the microphones 70 and/or the input audio signals 24 is coextensive with the entirety or substantially the entirety of the site 80.

The plurality of microphones 70 may include and/or may be arranged in a microphone array 72. Microphone array 72 includes a plurality of microphones that are arranged in a selected spatial arrangement relative to each other. A microphone array may be an installation of microphones and/or an arrangement of microphones present on an integrated device. Integrated devices may include a power supply, a signal conditioner, and/or a signal transceiver (e.g., an audio transducer) to generate and/or to transmit the audio signal or signals from the microphones of the array.

The audio conferencing system 10 includes an adaptive beamforming module 14 and an adaptive acoustic echo cancellation module 30 that each provide at least one status indicator of the respective adaptive module's state of functioning (i.e., respectively a beamforming status indicator 20 and an AEC status indicator 36). The status indicators indicate at least an aspect of the adaptation state of the adaptive module. For example, the status indicators may indicate a settled state, an unsettled state, or a functional parameter related to the settled state and/or the unsettled state.

As used and described herein, adaptive beamforming, the adaptive beamforming module 14, adaptive acoustic echo cancellation, and the adaptive acoustic echo cancellation module 30 are techniques and modules that change performance according to the inputs (audio inputs and/or control inputs). The term adaptive is used in contrast to non-adaptive, which describes techniques and modules that do not change performance according to the inputs. Adaptive techniques and modules may be referred to as dynamic, time varying, and/or data-dependent. Non-adaptive techniques and modules may be referred to as static, fixed, time invariant, and/or data-independent. Adaptive beamforming, the adaptive beamforming module 14, adaptive acoustic echo cancellation, and the adaptive acoustic echo cancellation module 30 are techniques and modules that include at least one aspect that is adaptive as described herein, and are not limited to a single adaptive aspect or a specific adaptive aspect for all embodiments. For example, some prior art adaptive beamformers are defined by having an adaptive filter for each microphone input. However, adaptive beamforming and the adaptive beamforming module 14 are not required to have adaptive filters (though they may use such).

The adaptive beamforming module 14 is configured to receive the plurality of input audio signals 24 and to generate a beamformed audio signal 28 based upon a combination of the plurality of input audio signals 24. The adaptive beamforming module 14 has an audio input 22 and an audio output 26 respectively configured to receive the plurality of input audio signals 24 and to transmit the beamformed audio signal 28. Generally, the adaptive beamforming module 14 includes or is a beamformer that combines the plurality of input audio signals 24 for directional reception from the plurality of microphones 70 (i.e., the microphone array 72). In some embodiments, the adaptive beamforming module 14 mixes and/or combines the plurality of input audio signals 24 to produce a mixed and/or combined signal without necessarily performing a beamforming function. Hence, the adaptive beamforming module 14 may be referred to as an adaptive mixing module 14 and/or an adaptive signal combination module 14. Similarly, the beamformed audio signal 28 may be referred to as a mixed audio signal 28 and/or a combined audio signal 28.

The adaptive acoustic echo cancellation module 30 is configured to receive the beamformed audio signal 28 from the adaptive beamforming module 14 (directly or indirectly) and to generate the near-end audio signal 42 (also called the echo-cancelled audio signal 42). Because the adaptive beamforming module 14 operates on the plurality of input audio signals 24 first and the adaptive acoustic echo cancellation module 30 operates on the beamformed audio signal 28 from the adaptive beamforming module 14, the audio conferencing system 10 is in a beamforming-first configuration. The adaptive acoustic echo cancellation module 30 is configured to generate the echo-cancelled audio signal 42 based upon the beamformed audio signal 28 and the far-end audio signal 44. The adaptive acoustic echo cancellation module 30 has an audio input 38 and an audio output 40 respectively configured to receive the beamformed audio signal 28 and to transmit the echo-cancelled audio signal 42 (i.e., the near-end audio signal 42).

Each of the adaptive beamforming module 14 and the adaptive acoustic echo cancellation module 30 has a controllable adaptivity. The adaptivity of an adaptive module is the amount or extent of adaptation that the adaptive module may perform. For example, the adaptivity may be expressed as an adaptation rate (how fast the adaptive module responds to changes) and/or an adaptation level (how much the adaptive module responds to changes). Each of the adaptive beamforming module 14 and the adaptive acoustic echo cancellation module 30 has a nominal adaptivity, which also may be referred to as a normal adaptivity, a default adaptivity, or a standard adaptivity. At nominal adaptivity, the adaptive module operates normally and adapts to changing conditions. The adaptivities of the adaptive modules may be controlled by at least one adaptation parameter, i.e., a beamforming adaptation parameter 18 for the adaptive beamforming module 14 and an AEC adaptation parameter 34 for the adaptive acoustic echo cancellation module 30. For example, the adaptive beamforming module 14 may generate the beamformed audio signal 28 based upon the beamforming adaptation parameter 18 and the adaptive acoustic echo cancellation module 30 may generate the echo-cancelled audio signal 42 based upon the AEC adaptation parameter 34.

The system 10 further includes an adaptation control module 50. The adaptation control module 50 is configured to control the adaptivity of the adaptive modules based upon the adaptation states of the adaptive modules. More specifically, the adaptation control module 50 is configured to control the beamforming adaptivity of the adaptive beamforming module 14 based upon the AEC adaptation state of the adaptive acoustic echo cancellation module 30 and configured to control the AEC adaptivity of the adaptive acoustic echo cancellation module 30 based upon the beamforming adaptation state of the adaptive beamforming module 14. The adaptation control module 50 may be configured to control the adaptivity of one or more of the adaptive modules based upon the adaptation state of that adaptive module. For example, the adaptation control module 50 may be configured to control the beamforming adaptivity of the adaptive beamforming module 14 based upon the beamforming adaptation state and/or may be configured to control the AEC adaptivity of the adaptive acoustic echo cancellation module 30 based upon the AEC adaptation state.

The adaptation control module 50 is configured to receive the status indicators (20, 36) from each of the adaptive beamforming module 14 and the adaptive acoustic echo cancellation module 30. The adaptation control module 50 is configured to transform these status indicators (additionally or alternatively based upon other system conditions such as far-end audio activity, near-end audio activity, and/or double-talk activity as discussed further herein) into adaptation parameters (18, 34) that may control the adaptivities of the adaptive modules. The adaptation control module 50 is configured to provide the adaptation parameters to the respective adaptive modules (i.e., beamforming adaptation parameter 18 to the adaptive beamforming module 14 and AEC adaptation parameter 34 to the adaptive acoustic echo cancellation module 30).

The adaptation control module 50 transforms status indicators into adaptation parameters through compensation functions. In general form, a compensation function generates adaptation parameters that modify the adaptivity of one adaptive module while the other adaptive module is adapting to changed conditions (i.e., it is in an unsettled state). The compensation function also may generate adaptation parameters that establish nominal adaptivity of one adaptive module while the other adaptive module has adapted to changed (prior) conditions (i.e., it is in a settled state). Adaptation parameters that establish nominal adaptivity of the adaptive module and/or that cause the adaptive module to operate with nominal adaptivity may be referred to as nominal-adaptation parameters. Modification of the adaptivity may be a change from the prior or nominal adaptivity, and may be an increase or reduction in adaptivity. Adaptation parameters that modify the adaptivity of the adaptive module and/or that cause the adaptive module to operate with modified adaptivity may be referred to as modified-adaptation parameters. Adaptation parameters that reduce the adaptivity of the adaptive module and/or that cause the adaptive module to operate with reduced adaptivity may be referred to as reduced-adaptation parameters. Adaptation parameters that increase the adaptivity of the adaptive module and/or that cause the adaptive module to operate with increased adaptivity may be referred to as increased-adaptation parameters.

Generally, adaptation (the adjustment to changing conditions in an unsettled state) responds to transient events in the environment or the adaptive modules. Hence, the modified adaptivity of one adaptive module due to an unsettled state of the other adaptive module generally is a temporary change. The adaptivity of the one adaptive module may be restored to nominal adaptivity after the other adaptive module returns to a settled state. For example, the adaptation control module 50 may reduce the beamforming adaptivity of the adaptive beamforming module 14 (via the beamforming adaptation parameter 18) when the AEC adaptation state of the adaptive acoustic echo cancellation module 30 is unsettled (as indicated by the AEC status indicator 36) and restore the beamforming adaptivity (via the beamforming adaptation parameter 18) when the AEC adaptation state is settled (as indicated by the AEC status indicator 36). Similarly, the adaptation control module 50 may increase the AEC adaptivity of the adaptive acoustic echo cancellation module 30 (via the AEC adaptation parameter 34) when the beamforming adaptation state of the adaptive beamforming module 14 is unsettled (as indicated by the beamforming status indicator 20) and restore the AEC adaptivity (via the AEC adaptation parameter 34) when the beamforming adaptation state is settled (as indicated by the beamforming status indicator 20).

Operating the adaptive beamforming module 14 at reduced adaptivity while the adaptive acoustic echo cancellation module 30 is in an unsettled state (e.g., not yet converged on an echo path) may reduce the complexity of estimating and/or modelling the echo path due to beamforming changes (e.g., beam direction changes). Operating the adaptive acoustic echo cancellation module 30 at increased adaptivity while the adaptive beamforming module 14 is in an unsettled state (e.g., tracking a sound source) may reduce audio artifacts due to the changing echoes observed by the changing beam direction.

Changes to adaptivities and/or to adaptation parameters may cause audio artifacts if implemented as step changes. To avoid audio artifacts, changes to adaptivities and/or to adaptation parameters may be smoothed. The type and/or amount of smoothing may depend on the direction of the change, the status of the module (e.g., settled or unsettled), and/or other system conditions (e.g., audio activity conditions such as far-end audio activity, near-end audio activity, and/or double-talk activity). For example, the onset of a nominal adaptivity after a reduced adaptivity may be faster than the onset of a reduced adaptivity after a nominal adaptivity. Smoothing of adaptivity changes and/or adaptation parameter changes may be implemented in the adaptation control module 50 and/or in the respective adaptive module.

Figure 2:
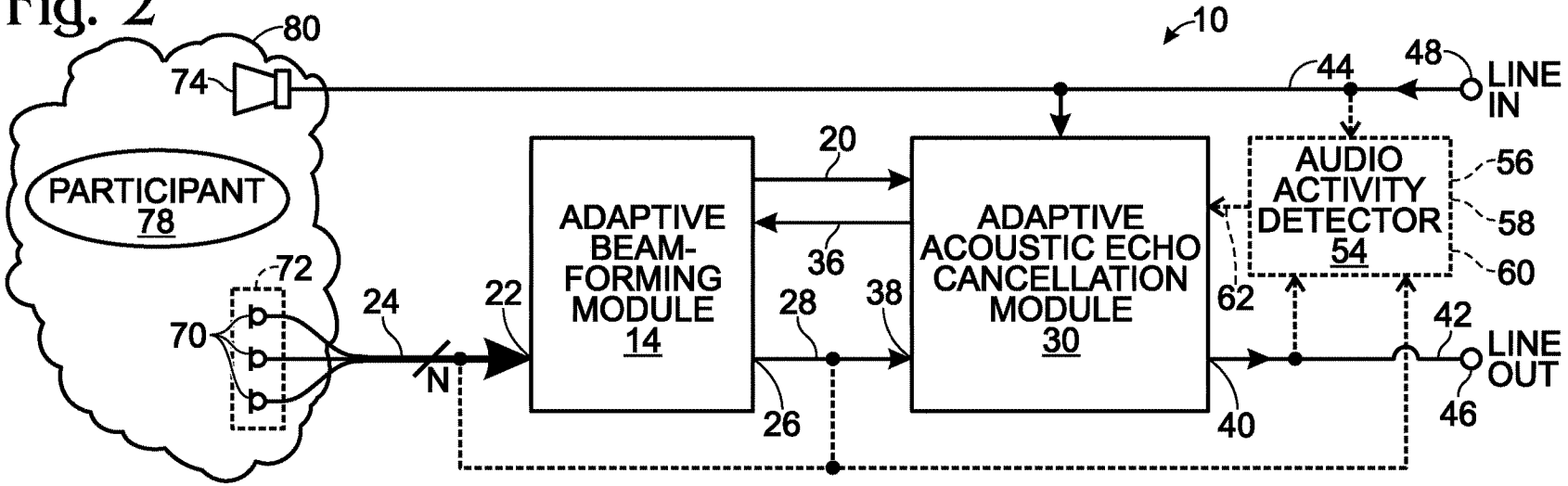
FIG. 2 is a schematic representation of another example of an audio conferencing system of the present disclosure.

In some embodiments, the adaptation control module 50 is embedded and/or distributed in one or more of the adaptive modules (adaptive beamforming module 14 and/or adaptive acoustic echo cancellation module 30). For example, FIG. 2 illustrates an audio conferencing system 10 that includes aspects of the adaptation control module 50 in each of the adaptive control modules. The adaptive control modules, adaptive beamforming module 14 and adaptive acoustic echo cancellation module 30, exchange respective status indicators, i.e., beamforming status indicator 20 and AEC status indicator 36. The receiving adaptive module's response to the status indicator (to potentially change its adaptivity) is performed by the receiving adaptive module rather than in a separate adaptation control module 50 (hence, no separate adaptation control module 50 is shown in FIG. 2).

In the example of FIG. 2, the adaptive beamforming module 14 is configured to receive the AEC status indicator 36 and to control the beamforming adaptivity based upon the AEC status indicator 36. Hence, the adaptive beamforming module 14 is configured to generate the beamformed audio signal 28 based upon the AEC status indicator 36. Similarly, the adaptive acoustic echo cancellation module 30 is configured to receive the beamforming status indicator 20 and to control the AEC adaptivity based upon the beamforming status indicator 20. Hence, the adaptive acoustic echo cancellation module 30 is configured to generate the echo-cancelled audio signal 42 based upon the beamforming status indicator 20.

Further, the adaptive beamforming module 14 and/or the adaptive acoustic echo cancellation module 30 may be configured to determine adaptation parameters to control the adaptive module's adaptivity based upon the status indicators received from the other adaptive module. The control of the adaptive module's adaptivity and the effect of the adaptation parameters are as described with respect to the adaptation control module 50 providing the adaptation parameters.

Figure 3:
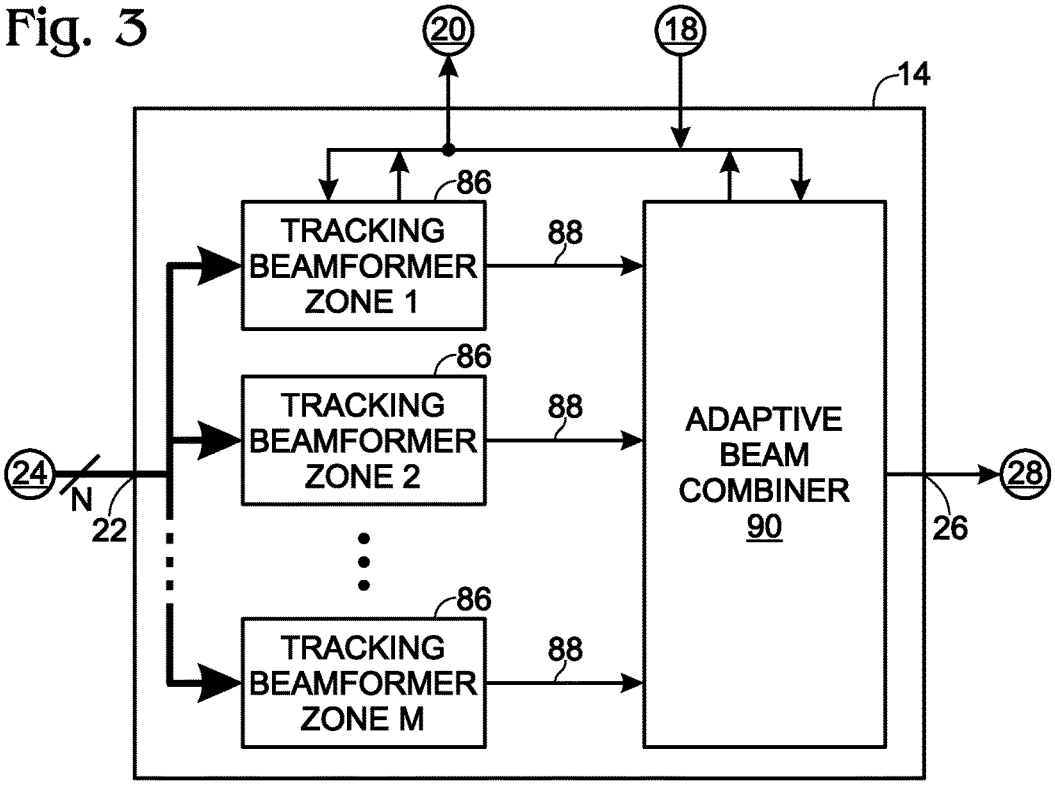
FIG. 3 is a schematic representation of an adaptive beamforming module of the present disclosure.

FIG. 3 illustrates an example of the adaptive beamforming module 14. The adaptive beamforming module 14 includes an adaptive beam combiner 90 that is configured to combine the plurality of input audio signals 24 (as optionally processed by upstream elements) into a single combined output audio signal. In the example of FIG. 3, the output of the adaptive beam combiner 90 is the output of the adaptive beamforming module 14 and therefore is the beamformed audio signal 28.

Generally, the adaptive beamforming module 14 combines the input audio signals 24 to localize the source position of the talker and thereby provide ambient noise reduction while improving the quality of the talker audio signal. The adaptive beamforming module 14 may be configured to locate and/or track prominent sound sources at the site 80 (reception space). The sound sources may be intentional sound sources such as the voice of the participant 78 or may be unintentional or undesired sound sources such as noise.

The adaptive beam combiner 90 may apply a signal-dependent weight and/or filter to each of the input signals (e.g., the input audio signals 24 as optionally processed by upstream elements) and mix the processed signals to generate the combined output audio signal that substantially and/or selectively conveys a signal of the talker. Combining input signals in this manner is referred to as beam steering and generally involves steering the sensitivity of the combined output audio signal to one of several zones of the site 80. The performance of the adaptive beam combiner 90 may be controlled by a mixer time constant (how fast changes in mixing are implemented), a target signal to noise ratio, a beam selectivity (comparing the talker signal to other signals), beam directivity (the size and/or location of the beam of sensitivity), the net input signal gain, and/or the individual input signal gains.

The adaptive beamforming module 14 may include one or more tracking beamformers 86 that are each configured to produce an output signal that represents the prominent sound source(s) within the input signals (the input domain of the tracking beamformer 86). The tracking beamformers 86 typically are each assigned to a zone of the site 80, as indicated in the example of FIG. 3. The number of zones (indicated as M in FIG. 3) may be less than, greater than, or equal to the number input audio signals 24 (indicated as N in FIG. 3). In FIG. 3, the inputs to each of the tracking beamformers 86 are all the same and are the plurality of input audio signals 24. In some embodiments, the inputs to two or more of the tracking beamformers 86 may be different from each other. For example, each tracking beamformer may receive a different subset of the plurality of input audio signals 24. The outputs from each of the tracking beamformers 86 are beam audio signals 88. Each beam audio signal 88 corresponds to one zone. The beam audio signals 88 are the inputs to the adaptive beam combiner 90.

Within the input domain of the tracking beamformer 86, the tracking beamformer may identify a location of the prominent sound source and/or may generate an output audio signal that substantially and/or selectively conveys the signal of the prominent sound within the input domain. Typically, the tracking beamformer 86 is configured to locate the prominent sound source within the input domain with higher precision than with a fixed beam steered to some default location, and/or the combination of several such fixed beams using the adaptive beam combiner 90.

The performance of the tracking beamformer 86 may be controlled by an update rate (how fast new sources may be identified), a tracking rate (how fast a source may move), a change time constant (how fast changes are implemented), a target signal to noise ratio, a beam selectivity, and/or a beam directivity.

Techniques of beamforming, beam tracking, and/or beam steering may include the delay-sum method, the filter-sum method, the superdirective method the time difference of arrival method, and the steered response power method.

The adaptive beamforming module 14 is configured to be controlled by at least one beamforming adaptation parameter 18 and to provide at least one beamforming status indicator 20. Beamforming adaptation parameters 18 may include a parameter or combination of parameters that control the tracking beamformer 86 and/or the adaptive beam combiner 90. Beamforming adaptation parameters 18 may be generally classified as beamforming adaptation rate parameters and beamforming adaptation level parameters. Beamforming adaptation rate parameters affect the rate of adaptation (how fast the adaptive beamforming module reacts to changes) and generally affect the rate of change of the beamformed audio signal in response to changes in input. Beamforming adaptation rate parameters include an update rate of the tracking beamformer 86 and a mixer time constant of the adaptive beam combiner 90. Beamforming adaptation level parameters affect the level or amount of adaptation (how much the adaptive beamforming module reacts to changes) and generally affect the adaptation performance level of the adaptive beamforming module. Beamforming adaptation level parameters include a beam selectivity, a beam directivity, a beam size, a target beam signal to noise ratio, and a gain of the adaptive beam combiner 90.

Beamforming status indicators 20 may include a variable or combination of variables that indicate the status (such as relating to a settled state or an unsettled state) of the adaptive beamforming module 14, the tracking beamformer 86, and/or the adaptive beam combiner 90. Beamforming status indicators 20 may be generally classified as beamforming activity indicators, beamforming location indicators, and beamforming performance indicators. Beamforming activity indicators indicate the activity of the tracking beamformer 86, the adaptive beam combiner 90, an audio input, an audio output, and/or other components of the adaptive beamforming module 14. Beamforming activity indicators include audio activity (e.g., in one or more of the input audio signals 24, in one or more of the beam audio signals 88, and/or in the beamformed audio signal 28). Beamforming location indicators indicate a location related to the adaptive beamforming module 14 and the signals it processes. Beamforming location indicators include a location related to at least one of the input audio signals 24, a talker location, a loudspeaker location, a noise source location, and a microphone location. Locations may be a zone, a three-dimensional position, a three-dimensional direction, a two-dimensional position, and/or a two-dimensional direction. Beamforming performance indicators indicate the current performance of the tracking beamformer 86, the adaptive beam combiner 90, and/or other components of the adaptive beamforming module 14. Beamforming performance indicators may be current values of beamforming adaptation parameters. For example, beamforming performance indicators include the update rate of the tracking beamformer 86, the gain of the adaptive beam combiner 90, and the mixer time constant of the adaptive beam combiner 90.

Figure 4:
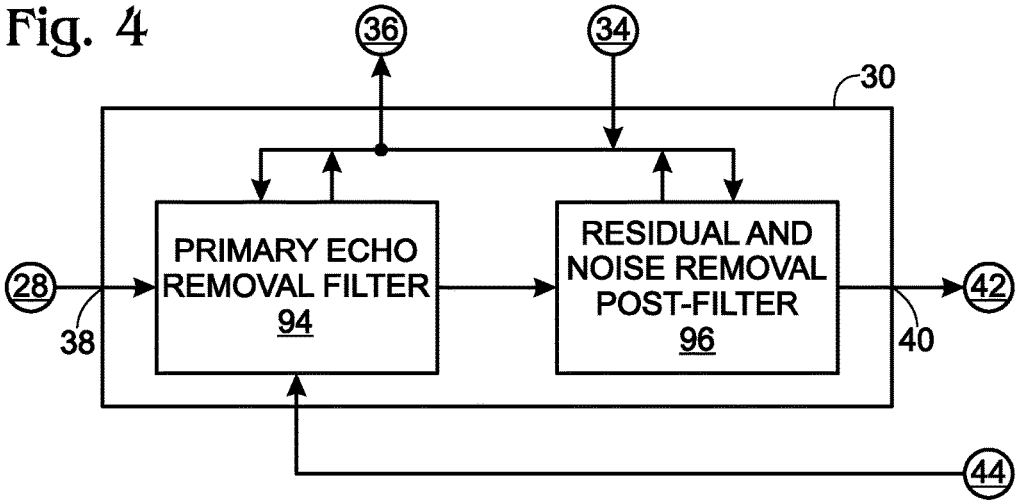
FIG. 4 is a schematic representation of an adaptive acoustic echo cancellation module of the present disclosure.

FIG. 4 illustrates an example of the adaptive acoustic echo cancellation module 30. In FIG. 4, the adaptive acoustic echo cancellation module 30 includes a primary echo removal filter 94 and a residual and noise removal post-filter 96.

Generally, the adaptive acoustic echo cancellation module 30 estimates and/or models the echo in its input signal (the beamformed audio signal 28) based upon the far-end audio signal 44 and filters the input signal to remove the estimated and/or modelled echo. The primary echo removal filter 94 generally is implemented as an iterative/adaptive filter to estimate the echo signal and subtracts the estimate from the input signal, typically with feedback. The primary echo removal filter 94 may converge to the estimated and/or modelled echo signal. While the primary echo removal filter 94 is not converged, the echo cancellation may be incomplete. Additionally, the primary echo removal filter 94 typically underestimates the echo signal, leaving a residual echo signal even when the primary echo removal filter 94 is converged. The residual and noise removal post-filter 96 may include a non-linear filter, a background estimation module, a comfort noise generator, and/or other filters configured to suppress residual echo signals after the primary echo removal filter 94.

Techniques of acoustic echo cancellation may include domain-based approaches (e.g., time-domain, frequency-domain, subband-domain, etc.) and/or adaptive filters (e.g., least mean square adaptive filters, recursive least mean square adaptive filters, normalized least mean square adaptive filters, affine projection adaptive filters, etc.).

The adaptive acoustic echo cancellation module 30 is configured to be controlled by at least one AEC adaptation parameter 34 and to provide at least one AEC status indicator 36. AEC adaptation parameters 34 may include a parameter or combination of parameters that control the primary echo removal filter 94 and/or the residual and noise removal post-filter 96. AEC adaptation parameters 34 may be generally classified as AEC adaptation rate parameters and AEC adaptation level parameters. AEC adaptation rate parameters affect the rate of adaptation (how fast the adaptive acoustic echo cancellation module reacts to changes) and generally affect the rate of change of the echo-cancelled audio signal 42 in response to changes in input. AEC adaptation rate parameters include a convergence rate of the primary echo removal filter 94. AEC adaptation level parameters affect the level or amount of adaptation (how much the adaptive acoustic echo cancellation module reacts to changes) and generally affect the adaptation performance level of the adaptive acoustic echo cancellation module. AEC adaptation level parameters may include a target echo return loss enhancement (the echo signal attenuation applied by the adaptive acoustic echo cancellation module 30), a target combined echo loss (the echo signal attenuation including effects of the site 80 and the adaptive acoustic echo cancellation module 30), and a target residual echo signal level (the remaining echo signal after the adaptive acoustic echo cancellation module 30). Additionally or alternatively, the AEC adaptation parameter may be a relative contribution of the adaptive primary echo removal filter and the residual and noise removal post-filter to the echo-cancelled audio signal 42 (e.g., to the echo remaining in the echo-cancelled audio signal 42).

AEC status indicators 36 may include a variable or combination of variables that indicate the status (such as relating to a settled state or an unsettled state) of the adaptive acoustic echo cancellation module 30, the primary echo removal filter 94, and/or the residual and noise removal post-filter 96. AEC status indicators 36 may be generally classified as AEC activity indicators and AEC performance indicators. AEC activity indicators indicate the activity of the primary echo removal filter 94, the residual and noise removal post-filter 96, an audio input, an audio output, and/or other components of the adaptive acoustic echo cancellation module 30. AEC activity indicators include audio activity (e.g., in one or more of the input audio signals 24, in the beamformed audio signal 28, in the echo-cancelled audio signal 42 (the near-end audio signal 42), and/or in the far-end audio signal 44. AEC performance indicators indicate the current performance of the primary echo removal filter 94, the residual and noise removal post-filter 96, and/or other components of the adaptive acoustic echo cancellation module 30. AEC performance indicators may be current values of AEC adaptation parameters 34. AEC performance indicators may include an error return loss enhancement, a room attenuation level, a residual echo signal level, a background noise level, and a convergence level of the primary echo removal filter 94.

Returning to FIG. 1 generally, audio conferencing systems 10 may include an audio activity detector 54. Additionally or alternatively, each of the adaptive beamforming module 14 and the adaptive acoustic echo cancellation module 30 independently may include an audio activity detector 54. The audio activity detector 54 is configured to receive an input signal (i.e., at least one of the audio signals of the audio conferencing system 10) and provide an audio activity status 62 to the adaptive beamforming module 14, the adaptive acoustic echo cancellation module 30, and/or the adaptation control module 50. The audio activity status 62 may be connected directly or indirectly to the receiving module or modules. For clarity in the figures, the audio activity status 62 is not directly connected to the adaptive beamforming module 14 though such connection is within the scope of the present disclosure.

The module or modules that receive the audio activity status 62 may operate and/or adapt based upon the audio activity status 62. Hence, the adaptive beamforming module 14 may be configured to generate the beamformed audio signal 28 based upon the audio activity status 62. The adaptive beamforming module may be configured to change the beamforming adaptivity based upon the audio activity status 62. The adaptive acoustic echo cancellation module 30 may be configured to generate the echo-cancelled audio signal 42 based upon the audio activity status 62. The adaptive acoustic echo cancellation module 30 may be configured to change the AEC adaptivity based upon the audio activity status. The beamforming adaptation state may be based upon the audio activity status 62. The adaptation control module 50 may be configured to control the AEC adaptivity based upon the audio activity status. The adaptation control module 50 may be configured to provide the AEC adaptation parameter 34 to the adaptive acoustic echo cancellation module 30 based upon the audio activity status 62. The AEC adaptation state may be based upon the audio activity status 62. The adaptation control module 50 may be configured to control the beamforming adaptivity based upon the audio activity status 62. The adaptation control module 50 may be configured to provide the beamforming adaptation parameter 18 to the adaptive beamforming module 14 based upon the audio activity status.

The audio activity status 62 is an activity level of one or more audio signals such as the input audio signals 24, the beamformed audio signal 28, the echo-cancelled audio signal 42 (the near-end audio signal 42), the far-end audio signal 44, and/or a mixture of any of the given audio signals. The activity level may be the presence of a signal, a signal level that is above a threshold value, and/or a signal level that is a threshold value above a noise floor for the given audio signal. Signal levels additionally or alternatively may be signal levels within a given frequency band. The activity level may relate to a voice signal and, hence, may be referred to as a voice level. A voice level may be determined by a signal within a given frequency band or with given characteristics representative of voices. Though the term voice may be used for some types of activity levels and the associated audio activity detectors 54 and audio activity statuses 62, the term voice is not limited to the voices of participants 78 (local or remote). Voice may generally describe intended audio signals and/or sources and is distinguished from unintended and/or undesired audio signals and/or sources (noise signals and/or sources). The activity level may relate to a noise signal and, hence, may be referred to as a noise level. A noise level may be determined by observing a signal without any intended or undesired sound sources present.

The audio activity detector 54 may include, and/or may be, a far-end activity detector 56, a near-end activity detector 58, and/or a double-talk detector 60. Far-end activity detectors 56 are configured to provide the audio activity status 62 based upon an activity level of the far-end audio signal 44. For example, the audio activity status 62 may be far-end voice activity or far-end noise activity. Near-end activity detectors 58 are configured to provide the audio activity status 62 based upon an activity level of a near-end signal. Near-end signals may be the input audio signals 24, the beamformed audio signal 28, the echo-cancelled audio signal 42, and/or a mixture of any of the given audio signals. Additionally or alternatively, the audio activity status 62 of the near-end activity detector 58 may indicate that one or more of the microphones 70 are receiving audio activity. Double-talk detectors 60 are configured to provide the audio activity status 62 based upon an activity level of the far-end audio signal 44 (like a far-end activity detector 56) and an activity level of a near-end signal (like a near-end activity detector 58). Double-talk detectors 60 may be combinations of far-end activity detectors 56 and near-end activity detectors 58. Double-talk detectors 60 are configured to detect audio and/or voice signals occurring simultaneously (except for echo delay and/or distortion) at both the local site (near end) and the remote site (far end). For example, double-talk detectors 60 may be configured to detect audio and/or voice signals at both the far end and the near end by calculating a correlation between the far-end audio signal and one or more of the near-end signals. Audio activity detectors 54 may be configured to detect audio and/or voice signals occurring at just one of the local site or the remote site and, hence, may be referred to as near-end single-talk detectors and far-end single-talk detectors respectively. The activity detected by a single-talk detector, and indicated by the audio activity status 62, may be referred to as single-talk activity.

In some embodiments, audio conferencing systems 10 (and/or components thereof) may be configured to control the adaptivity of the adaptive beamforming module 14 and/or the adaptive acoustic echo cancellation module 30 based upon the audio activity status 62 such as double-talk activity and/or single-talk activity. Generally, at a site 80, the status of talkers may be remote talker active (far-end single-talk activity), local talker active (near-end single-talk activity), both remote and local talkers active (double-talk activity), and no talkers active.

During far-end single-talk activity, no local talker is present and the adaptive beamforming module 14 has no valid talker signal to find or steer towards, other than the undesired loudspeaker direction. In the absence of a valid local talker, a conventional adaptive beamformer would track toward the loudspeaker, resulting in undesirable amplification of echo. During far-end single-talk activity, the adaptive beamforming module 14 may be commanded to operate (and/or may operate) at modified adaptivity (e.g., reduced adaptivity such as very slowly changing or locked into a particular zone). The adaptive acoustic echo cancellation module 30 may be commanded to operate (and/or may operate) at nominal adaptivity.

During near-end single-talk activity, no remote talker is present and the adaptive acoustic echo cancellation module 30 has no far-end audio and/or voice signal to use to estimate and/or model the local echo. The far-end audio signal 44 may include noise and other undesired sources, in which case, the adaptive acoustic echo cancellation module 30 may be useful to remove echoes and potential feedback from those sources. The adaptive acoustic echo cancellation module 30 may be commanded to operate (and/or may operate) at modified adaptivity (e.g., reduced adaptivity such as very slowly converging or disabled). The adaptive beamforming module 14 may be commanded to operate (and/or may operate) at nominal adaptivity.

During double-talk activity, the audio conferencing system 10 may be configured to avoid unsettled states of the adaptive modules at the same time. The adaptation of one adaptive module may be prioritized over the other. For example, echo path changes may be a priority over tracking a local talker. During double-talk activity, the adaptive beamforming module 14 may be commanded to operate (and/or may operate) at modified adaptivity (e.g., reduced adaptivity) while the adaptive acoustic echo cancellation module 30 is in an unsettled state (adapting to changed conditions, e.g., not converged). While the adaptive acoustic echo cancellation module 30 is in a settled state (adapted to changed conditions, e.g., converged), the adaptive beamforming module 14 may be commanded to operate (and/or may operate) at nominal adaptivity. Also while the adaptive acoustic echo cancellation module 30 is in a settled state, the adaptive acoustic echo cancellation module 30 may be commanded to operate (and/or may operate) at modified adaptivity (e.g., increased adaptivity) while the adaptive beamforming module 14 is in an unsettled state (adapting to change conditions, e.g., tracking movement of a local talker). While both the adaptive beamforming module 14 and the adaptive acoustic echo cancellation module 30 are in settled states (adapted to changed conditions), both adaptive modules may be commanded to operate (and/or may operate) at nominal adaptivity.

While no talkers are active, both adaptive modules may retain their respective prior adaptivities (e.g., nominal adaptivity or modified adaptivity) or may be commanded to operate (and/or may operate) at modified adaptivity (e.g., reduced adaptivity).

Figure 5:
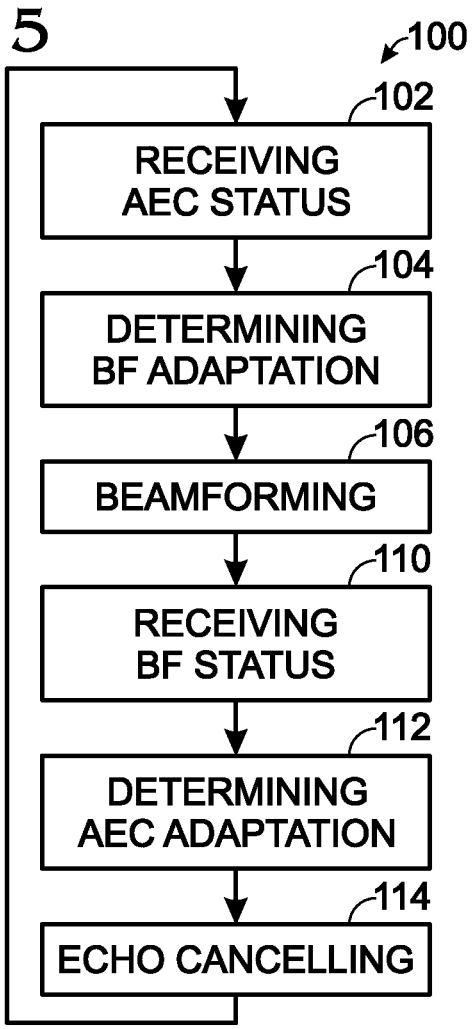
FIG. 5 is a schematic representation of methods of combined beamforming and acoustic echo cancellation according to the present disclosure.

FIG. 5 schematically represents methods 100 of combined beamforming and acoustic echo cancellation. Methods 100, in whole or in part, may be performed with and/or by the systems 10 and/or components thereof. Methods 100 include receiving 102 at least one AEC status indicator (e.g., AEC status indicator 36) from an adaptive acoustic echo cancellation module (e.g., adaptive acoustic echo cancellation module 30). The AEC status indicator may indicate that the adaptive acoustic echo cancellation module is in a particular state such as an unsettled state (adapting to changed conditions) or a settled state (adapted to changed conditions). Methods 100 may include determining 104 a beamforming adaptation parameter (e.g., beamforming adaptation parameter 18) based upon the AEC status indicator.

Methods 100 may include beamforming 106 based upon the AEC status indicator and/or the beamforming adaptation parameter. Beamforming 106 includes beamforming with an adaptive beamforming module (e.g. adaptive beamforming module 14) and includes beamforming a plurality of input audio signals (e.g., plurality of input audio signals 24) into a beamformed audio signal (e.g., beamformed audio signal 28). Beamforming 106 may be at modified adaptivity (e.g., based upon a beamforming modified-adaptation parameter such as a reduced-adaptation parameter) if the adaptive acoustic echo cancellation module is in an unsettled state as indicated by the AEC status indicator (the adaptive module is adapting to changed conditions). Beamforming 106 at modified adaptivity may be performed during the period that the adaptive acoustic echo cancellation module is in an unsettled state as indicated by the AEC status indicator. Beamforming 106 at modified adaptivity may be interrupted if the adaptive beamforming module enters an unsettled state.

Beamforming 106 may be at nominal adaptivity (e.g., based upon a beamforming nominal-adaptation parameter) if the adaptive acoustic echo cancellation module is in a settled state as indicated by the AEC status indicator (the adaptive module is adapted to changed conditions). Beamforming 106 at nominal adaptivity may be performed during the period that the adaptive acoustic echo cancellation module is in a settled state as indicated by the AEC status indicator.

Methods 100 include receiving 110 at least one beamforming status indicator (e.g., beamforming status indicator 20) from the adaptive beamforming module. The beamforming status indicator may indicate that the adaptive beamforming module is in a particular state such as an unsettled state (adapting to changed conditions) or a settled state (adapted to changed conditions). Methods 100 may include determining 112 an AEC adaptation parameter (e.g., AEC adaptation parameter 34) based upon the beamforming status indicator.

Methods 100 may include echo-cancelling 114 based upon the beamforming status indicator and/or the AEC adaptation parameter. Echo-cancelling 114 includes echo-cancelling with the adaptive acoustic echo cancellation module and include echo-cancelling the beamformed audio signal to generate an echo-cancelled audio signal (e.g., echo-cancelled audio signal 42). Echo-cancelling 114 may be at modified adaptivity (e.g., based upon an AEC modified-adaptation parameter such as an AEC reduced-adaptation parameter or an AEC increased-adaptation parameter) if the adaptive beamforming module is in an unsettled state as indicated by the beamforming status indicator (the adaptive module is adapting to changed conditions). Echo-cancelling 114 at modified adaptivity may be performed during the period that the adaptive beamforming module is in an unsettled state as indicated by the beamforming status indicator. Echo-cancelling 114 at modified adaptivity may be interrupted if the adaptive acoustic echo cancellation module enters an unsettled state.

Echo-cancelling 114 may be at nominal adaptivity (e.g., based upon an AEC nominal-adaptation parameter) if the adaptive beamforming module is in a settled state as indicated by the beamforming status indicator (the adaptive module is adapted to the changed conditions). Echo-cancelling 114 at nominal adaptivity may be performed during the period that the adaptive beamforming module is in a settled state as indicated by the beamforming status indicator.

Methods 100 generally are performed repetitively and/or may include repeating. For example receiving 102, determining 104, beamforming 106, receiving 110, determining 112, and echo-cancelling 114 may be performed in a loop and/or based upon other conditions such as audio activity (e.g., as indicated by audio activity status 62 and/or by audio activity detector 54).

A specific example of methods 100 includes detecting far-end single-talk activity, near-end single-talk activity, and/or double-talk activity. During far-end single-talk activity, methods 100 include beamforming 106 with an adaptive beamforming module at reduced adaptivity (e.g., based upon a beamforming reduced-adaptation parameter) and echo-cancelling 114 with an adaptive acoustic echo cancellation module at nominal adaptivity (e.g., based upon the AEC nominal-adaptation parameter). During near-end single-talk activity, methods 100 include beamforming 106 with the adaptive beamforming module at nominal adaptivity (e.g., based upon the beamforming nominal-adaptation parameter) and echo-cancelling 114 with the adaptive acoustic echo cancellation module at reduced adaptivity (e.g., based upon the AEC reduced-adaptation parameter).

During double-talk activity, such methods 100 include selecting the adaptivity of the beamforming and echo cancellation based upon the adaptation states of the adaptive modules. While the adaptive acoustic echo cancellation module is in an unsettled state (adapting to changed conditions), beamforming 106 is performed at reduced adaptivity (e.g., based upon the beamforming reduced-adaptation parameter). While the adaptive acoustic echo cancellation module is in a settled state (adapted to changed conditions), beamforming 106 is performed at nominal adaptivity (e.g., based upon the beamforming nominal-adaptation parameter).

While the adaptive acoustic echo cancellation module is in a settled state (adapted to changed conditions) and while the adaptive beamforming module is in a settled state (adapted to changed conditions), echo-cancelling 114 is performed at nominal adaptivity (e.g., based upon the AEC nominal-adaptation parameter). While the adaptive acoustic echo cancellation module is in a settled state (adapted to changed conditions) and while the adaptive beamforming module is in an unsettled state (adapting to changed conditions), echo-cancelling 114 is performed at increased adaptivity (e.g., based upon the AEC increased-adaptation parameter).

Examples of inventive subject matter according to the present disclosure are described in the following enumerated paragraphs.

A1. An audio conferencing system comprising:

an adaptive beamforming module with a beamforming adaptivity and a beamforming adaptation state, wherein the adaptive beamforming module is configured to receive a plurality of input audio signals and to generate a beamformed audio signal based upon a combination of the plurality of input audio signals;

an adaptive acoustic echo cancellation module with an AEC adaptivity and an AEC adaptation state, wherein the adaptive acoustic echo cancellation module is configured to receive the beamformed audio signal and to generate an echo-cancelled audio signal based upon the beamformed audio signal and a far-end audio signal; and an adaptation control module that is configured to modify the beamforming adaptivity when the AEC adaptation state is unsettled, to modify the AEC adaptivity when the beamforming adaptation state is unsettled, to restore the beamforming adaptivity when the AEC adaptation state is settled, and to restore the AEC adaptivity when the beamforming adaptation state is settled.

A1.1. The audio conferencing system of paragraph A1, wherein the adaptation control module is configured to reduce the beamforming adaptivity when the AEC adaptation state is unsettled.

A1.2. The audio conferencing system of any of paragraphs A1-A1.1, wherein the adaptation control module is configured to increase the beamforming adaptivity when the AEC adaptation state is unsettled.

A1.3. The audio conferencing system of any of paragraphs A1-A1.2, wherein the adaptation control module is configured to reduce the AEC adaptivity when the beamforming adaptation state is unsettled.

A1.4. The audio conferencing system of any of paragraphs A1-A1.3, wherein the adaptation control module is configured to increase the AEC adaptivity when the beamforming adaptation state is unsettled.

A2. The audio conferencing system of any of paragraphs A1-A1.4, wherein the adaptive beamforming module is configured to receive at least one beamforming adaptation parameter to control the beamforming adaptivity and is configured to provide at least one beamforming status indicator that indicates the beamforming adaptation state; and wherein the adaptive acoustic echo cancellation module is configured to receive at least one AEC adaptation parameter to control the AEC adaptivity and is configured to provide at least one AEC status indicator that indicates the AEC adaptation state.

A2.1. The audio conferencing system of paragraph A2, wherein the adaptive beamforming module is configured to generate the beamformed audio signal additionally based upon the beamforming adaptation parameter.

A2.2. The audio conferencing system of any of paragraphs A2-A2.1, wherein the adaptive acoustic echo cancellation module is configured to generate the echo-cancelled audio signal additionally based upon the AEC adaptation parameter.

A2.3. The audio conferencing system of any of paragraphs A2-A2.2, wherein at least one of the beamforming adaptation parameters is one of a beamforming adaptation rate parameter and a beamforming adaptation level parameter.

A2.3.1. The audio conferencing system of paragraph A2.3, wherein the beamforming adaptation rate parameter affects a rate of change of the beamformed audio signal.

A2.3.2. The audio conferencing system of any of paragraphs A2.3-A2.3.1, wherein the adaptive beamforming module includes a tracking beamformer and wherein the beamforming adaptation rate parameter is an update rate of the tracking beamformer.

A2.3.3. The audio conferencing system of any of paragraphs A2.3-A2.3.2, wherein the adaptive beamforming module includes an adaptive beam combiner and wherein the beamforming adaptation rate parameter is a mixer time constant of the adaptive beam combiner.

A2.3.4. The audio conferencing system of any of paragraphs A2.3-A2.3.3, wherein the beamforming adaptation level parameter affects a performance level of the adaptive beamforming module A2.3.5. The audio conferencing system of any of paragraphs A2.3-A2.3.4, wherein the beamforming adaptation level parameter includes at least one of, optionally is one of, a beam selectivity, a beam directivity, a beam size, and a target beam signal to noise ratio.

A2.3.6. The audio conferencing system of any of paragraphs A2.3-A2.3.5, wherein the adaptive beamforming module includes an adaptive beam combiner and wherein the beamforming adaptation level parameter is a gain of the adaptive beam combiner.

A2.4. The audio conferencing system of any of paragraphs A2-A2.3.6, wherein at least one of the beamforming status indicators is one of a beamforming activity indicator, a beamforming location indicator, and a beamforming performance indicator.

A2.4.1. The audio conferencing system of paragraph A2.4, wherein the beamforming activity indicator indicates audio activity at an input to the adaptive beamforming module, within the adaptive beamforming module, and/or at an output to the adaptive beamforming module.

A2.4.2. The audio conferencing system of any of paragraphs A2.4-A2.4.1, wherein the beamforming activity indicator includes at least one of, optionally is one of, a near-end voice activity, a double-talk activity, a beam voice activity, and a near-end noise activity.

A2.4.3. The audio conferencing system of any of paragraphs A2.4-A2.4.2, wherein the beamforming location indicator indicates a location related to at least one of the plurality of input audio signals.

A2.4.4. The audio conferencing system of any of paragraphs A2.4-A2.4.3, wherein the beamforming location indicator includes at least one of, optionally is one of, a talker location, a loudspeaker location, a noise source location, and a microphone location.

A2.4.4.1. The audio conferencing system of paragraph A2.4.4, wherein any of the locations includes a vector coordinate that indicates a three-dimensional position, a three-dimensional direction, a two-dimensional position, and/or a two-dimensional direction.

A2.4.5. The audio conferencing system of any of paragraphs A2.4-A2.4.4.1, wherein the beamforming performance indicator indicates one of a beamforming performance parameter and a beamforming adaptation parameter.

A2.4.6. The audio conferencing system of any of paragraphs A2.4-A2.4.5, wherein the adaptive beamforming module includes a tracking beamformer and wherein the beamforming performance indicator is an update rate of the tracking beamformer.

A2.4.7. The audio conferencing system of any of paragraphs A2.4-A2.4.6, wherein the adaptive beamforming module includes an adaptive beam combiner and wherein the beamforming performance indicator is one of a gain of the adaptive beam combiner and a mixer time constant of the adaptive beam combiner.

A2.5. The audio conferencing system of any of paragraphs A2-A2.4.7, wherein at least one of the AEC adaptation parameters is one of an AEC adaptation rate parameter and an AEC adaptation level parameter.

A2.5.1. The audio conferencing system of paragraph A2.5, wherein the AEC adaptation rate parameter affects a rate of change of the echo-cancelled audio signal.

A2.5.2. The audio conferencing system of any of paragraphs A2.5-A2.5.1, wherein the adaptive acoustic echo cancellation module includes a primary echo removal filter and wherein the AEC adaptation rate parameter is a convergence rate of the primary echo removal filter.

A2.5.3. The audio conferencing system of any of paragraphs A2.5-A2.5.2, wherein the AEC adaptation level parameter affects a performance level of the adaptive acoustic echo cancellation module.

A2.5.4. The audio conferencing system of any of paragraphs A2.5-A2.5.3, wherein the AEC adaptation level parameter includes at least one of, optionally is one of, a target echo return loss enhancement, a target combined echo loss, and a target residual echo signal level.

A2.6. The audio conferencing system of any of paragraphs A2-A2.5.4, wherein the adaptive acoustic echo cancellation module includes an adaptive primary echo removal filter and a residual and noise removal post-filter, and wherein the AEC adaptation parameter affects a relative contribution of the adaptive primary echo removal filter and the residual and noise removal post-filter to the echo-cancelled audio signal.

A2.7. The audio conferencing system of any of paragraphs A2-A2.6, wherein at least one of the AEC status indicators is one of an AEC activity indicator and an AEC performance indicator.

A2.7.1. The audio conferencing system of paragraph A2.7, wherein the AEC activity indicator indicates audio activity at an input to the adaptive acoustic echo cancellation module, within the adaptive acoustic echo cancellation module, and/or at an output of the adaptive acoustic echo cancellation module.

A2.7.2. The audio conferencing system of any of paragraphs A2.7-A2.7.1, wherein the AEC activity indicator includes at least one of, optionally is one of, a near-end voice activity, a double-talk activity, and a near-end noise activity.

A2.7.3. The audio conferencing system of any of paragraphs A2.7-A2.7.2, wherein the AEC performance indicator indicates one of an AEC performance parameter and an AEC adaptation parameter.

A2.7.4. The audio conferencing system of any of paragraphs A2.7-A2.7.3, wherein the AEC performance indicator includes at least one of, optionally is one of, an error return loss enhancement, a room attenuation level, a residual echo signal level, and a background noise level.

A2.7.5. The audio conferencing system of any of paragraphs A2.7-A2.7.4, wherein the adaptive acoustic echo cancellation module includes a primary echo removal filter and wherein the AEC performance indicator is a convergence level of the primary echo removal filter.

A2.8. The audio conferencing system of any of paragraphs A2-A2.7.5, wherein the adaptation control module is configured to provide an AEC modified-adaptation parameter when the beamforming status indicator indicates that the adaptive beamforming module is adapting to changed conditions.

A2.8.1. The audio conferencing system of paragraph A2.8, wherein the adaptive acoustic echo cancellation module is configured to operate with modified adaptivity in response to the AEC modified-adaptation parameter.

A2.8.2. The audio conferencing system of any of paragraphs A2.8-A2.8.1, wherein the AEC modified-adaptation parameter is an AEC reduced-adaptation parameter and optionally wherein the adaptive acoustic echo cancellation module is configured to operate with reduced adaptivity in response to the AEC reduced-adaptation parameter.

A2.8.3. The audio conferencing system of any of paragraphs A2.8-A2.8.2, wherein the AEC modified-adaptation parameter is an AEC increased-adaptation parameter and optionally wherein the adaptive acoustic echo cancellation module is configured to operate with increased adaptivity in response to the AEC increased-adaptation parameter.

A2.9. The audio conferencing system of any of paragraphs A2-A2.8.3, wherein the adaptation control module is configured to provide an AEC nominal-adaptation parameter when the beamforming status indicator indicates that the adaptive beamforming module is adapted to changed conditions.

A2.9.1. The audio conferencing system of paragraph A2.9, wherein the adaptive acoustic echo cancellation module is configured to operate with nominal adaptivity in response to the AEC nominal-adaptation parameter.

A2.10. The audio conferencing system of any of paragraphs A2-A2.9.1, wherein the adaptation control module is configured to provide a beamforming modified-adaptation parameter when the AEC status indicator indicates that the adaptive acoustic echo cancellation module is adapting to changed conditions.

A2.10.1. The audio conferencing system of paragraph A2.10, wherein the adaptive beamforming module is configured to operate with modified adaptivity in response to the beamforming modified-adaptation parameter.

A2.10.2. The audio conferencing system of any of paragraphs A2.10-A2.10.1, wherein the beamforming modified-adaptation parameter is a beamforming reduced-adaptation parameter and optionally wherein the adaptive beamforming module is configured to operate with reduced adaptivity in response to the beamforming reduced-adaptation parameter.

A2.10.3. The audio conferencing system of any of paragraphs A2.10-A2.10.2, wherein the beamforming modified-adaptation parameter is a beamforming increased-adaptation parameter and optionally wherein the adaptive beamforming module is configured to operate with increased adaptivity in response to the beamforming increased-adaptation parameter.

A2.11. The audio conferencing system of any of paragraphs A2-A2.10.3, wherein the adaptation control module is configured to provide a beamforming nominal-adaptation parameter when the AEC status indicator indicates that the adaptive acoustic echo cancellation module is adapted to changed conditions.

A2.11.1. The audio conferencing system of paragraph A2.11, wherein the adaptive beamforming module is configured to operate with nominal adaptivity in response to the beamforming nominal-adaptation parameter.

A2.12. The audio conferencing system of any of paragraphs A2-A2.11.1, wherein the adaptation control module is configured to provide the beamforming adaptation parameter to the adaptive beamforming module based upon the beamforming status indicator.

A2.13. The audio conferencing system of any of paragraphs A2-A2.12, wherein the adaptation control module is configured to provide the AEC parameter to the adaptive acoustic echo cancellation module based upon the AEC status indicator.

A3. The audio conferencing system of any of paragraphs A1-A2.13, wherein the adaptive beamforming module is configured to generate the beamformed audio signal based at least upon a filtered combination of the plurality of input audio signals.

A4. The audio conferencing system of any of paragraphs A1-A3, wherein the adaptive beamforming module includes an adaptive beam combiner.

A5. The audio conferencing system of any of paragraphs A1-A4, wherein the adaptive beamforming module includes one or more tracking beamformers.

A6. The audio conferencing system of any of paragraphs A1-A5, wherein the adaptive beamforming module includes an audio activity detector.

A7. The audio conferencing system of any of paragraphs A1-A6, wherein the adaptive beamforming module is configured for beam steering and combination.

A8. The audio conferencing system of any of paragraphs A1-A7, wherein the adaptive acoustic echo cancellation module includes a primary echo removal filter.

A9. The audio conferencing system of any of paragraphs A1-A8, wherein the adaptive acoustic echo cancellation module includes a residual and noise removal post-filter.

A10. The audio conferencing system of any of paragraphs A1-A9, wherein the adaptive acoustic echo cancellation module includes an audio activity detector.

A11. The audio conferencing system of any of paragraphs A1-A10, further comprising a plurality of microphones.

A11.1. The audio conferencing system of paragraph A11, wherein the plurality of microphones is configured to transmit the plurality of input audio signals based upon sound received at the microphones, optionally from a reception space.

A11.2. The audio conferencing system of any of paragraphs A11-A11.1, wherein each microphone is configured to produce one of the input audio signals for the beamforming module.

A11.3. The audio conferencing system of any of paragraphs A11-A11.2, wherein the plurality of microphones includes, optionally is, a microphone array.

A11.4. The audio conferencing system of any of paragraphs A11-A11.3, wherein a number of the plurality of microphones is greater than or equal to a number of the plurality of input audio signals.

A11.5. The audio conferencing system of any of paragraphs A11-A11.4, wherein each microphone is configured to receive sound from a zone of a reception space.

A12. The audio conferencing system of any of paragraphs A1-A11.5, further comprising a loudspeaker configured to render sound according to the far-end audio signal, optionally into a/the reception space.

A13. The audio conferencing system of any of paragraphs A1-A12, further comprising an audio activity detector that is configured to provide an audio activity status to at least one of the adaptive beamforming module, the adaptive acoustic echo cancellation module, and the adaptation control module.

A13.1. The audio conferencing system of paragraph A13, wherein the adaptive beamforming module is configured to generate the beamformed audio signal additionally based upon the audio activity status.

A13.2. The audio conferencing system of any of paragraphs A13-A13.1, wherein the adaptive beamforming module is configured to change the beamforming adaptivity based upon the audio activity status.

A13.3. The audio conferencing system of any of paragraphs A13-A13.2, wherein the adaptive acoustic echo cancellation module is configured to generate the echo-cancelled audio signal additionally based upon the audio activity status.

A13.4. The audio conferencing system of any of paragraphs A13-A13.3, wherein the adaptive acoustic echo cancellation module is configured to change the AEC adaptivity based upon the audio activity status.

A13.5. The audio conferencing system of any of paragraphs A13-A13.4, wherein the beamforming adaptation state is based upon the audio activity status.

A13.6. The audio conferencing system of any of paragraphs A13-A13.5, wherein the adaptation control module is configured to control the AEC adaptivity based upon the audio activity status.

A13.7. The audio conferencing system of any of paragraphs A13-A13.6, when also depending from paragraph A2, wherein the adaptation control module is configured to provide the AEC adaptation parameter to the adaptive acoustic echo cancellation module additionally based upon the audio activity status.

A13.8. The audio conferencing system of any of paragraphs A13-A13.7, wherein the AEC adaptation state is based upon the audio activity status.

A13.9. The audio conferencing system of any of paragraphs A13-A13.8, wherein the adaptation control module is configured to control the beamforming adaptivity based upon the audio activity status.

A13.10. The audio conferencing system of any of paragraphs A13-A13.9, when also depending from paragraph A2, wherein the adaptation control module is configured to provide the beamforming adaptation parameter to the adaptive beamforming module additionally based upon the audio activity status.

A13.11. The audio conferencing system of any of paragraphs A13-A13.10, wherein the audio activity detector includes, optionally is, a far-end activity detector that is configured to provide the audio activity status based upon an activity level of the far-end audio signal.

A13.11.1. The audio conferencing system of paragraph A13.11, wherein the far-end activity detector is configured to indicate, with the audio activity status, whether the activity level of the far-end audio signal is above a far-end audio threshold.

A13.12. The audio conferencing system of any of paragraphs A13-A13.11.1, wherein the audio activity detector includes, optionally is, a near-end activity detector that is configured to provide the audio activity status based upon at least one of an activity level of the plurality of input audio signals, an activity level of a mixture of one or more input audio signals of the plurality of input audio signals, an activity level of the beamformed audio signal, and an activity level of the echo-cancelled audio signal.

A13.12.1. The audio conferencing system of paragraph A13.12, wherein the near-end activity detector is configured to indicate, with the audio activity status, whether at least one of the activity level of the plurality of input audio signals, the activity level of the mixture of one or more input audio signals of the plurality of input audio signals, the activity level of the beamformed audio signal, and the activity level of the echo-cancelled audio signal is above a near-end audio threshold.

A13.12.2. The audio conferencing system of any of paragraphs A13.12-A13.12.1, when also depending from paragraph A11, wherein the near-end activity detector is configured to indicate, with the audio activity status, that one or more of the plurality of microphones is receiving audio activity.

A13.13. The audio conferencing system of any of paragraphs A13-A13.12.2, wherein the audio activity detector includes, optionally is, a double-talk detector that is configured to provide the audio activity status based upon an activity level of the far-end audio signal and at least one of an activity level of the plurality of input audio signals, an activity level of a mixture of one or more input audio signals of the plurality of input audio signals, an activity level of the beamformed audio signal, and an activity level of the echo-cancelled audio signal.

A13.13.1. The audio conferencing system of paragraph A13.13, wherein the double-talk detector is configured to indicate, with the audio activity status, whether the activity level of the far-end audio signal is above a far-end audio threshold and whether at least one of the activity level of the plurality of input audio signals, the activity level of the mixture of one or more input audio signals of the plurality of input audio signals, the activity level of the beamformed audio signal, and the activity level of the echo-cancelled audio signal is above a near-end audio threshold.

A13.13.2. The audio conferencing system of any of paragraphs A13.13-A13.13.1, when also depending from paragraph A11, wherein the double-talk detector is configured to indicate, with the audio activity status, whether the activity level of the far-end audio signal is above a far-end audio threshold and whether one or more of the plurality of microphones is receiving audio activity at an activity level that is above a near-end audio threshold.

A13.13.3. The audio conferencing system of any of paragraphs A13.13-A13.13.2, wherein the double-talk detector is configured to determine the audio activity status by calculating a correlation between the far-end audio signal and at least one of the input audio signals, the beamformed audio signal, and the echo-cancelled audio signal.

A13.14. The audio conferencing system of any of paragraphs A13-A13.13.3, wherein the far-end audio threshold, where used, is a predetermined value.

A13.15. The audio conferencing system of any of paragraphs A13-A13.14, wherein the far-end audio threshold, where used, is a predetermined value greater than a noise floor for the far-end audio signal.

A13.16. The audio conferencing system of any of paragraphs A13-A13.15, wherein the near-end audio threshold, where used, is a predetermined value.

A13.17. The audio conferencing system of any of paragraphs A13-A13.16, wherein the near-end audio threshold, where used, is a predetermined value greater than at least one of a noise floor for the plurality of microphones (when also depending from paragraph A11), a noise floor for a mixture of audio signals of one or more of the plurality of microphones (when also depending from paragraph A11), a noise floor for the beamformed audio signal, and a noise floor for the echo-cancelled audio signal.

A14. The audio conferencing system of any of paragraphs A1-A13.17, wherein the audio conferencing system is configured for communication between two or more sites with audio transmissions.

A15. The audio conferencing system of any of paragraphs A1-A14, wherein the audio conferencing system is an audio-video conferencing system that is configured for communication between two or more locations with audio and video transmissions.

A16. The audio conferencing system of any of paragraphs A1-A15, wherein the adaptive beamforming module, where used, is an adaptive mixer module and wherein the beamformed audio signal, where used, is a mixed audio signal.

A17. The audio conferencing system of any of paragraphs A1-A16, wherein the adaptive beamforming module, where used, is an adaptive signal combination module and wherein the beamformed audio signal, where used, is a combined audio signal.

B1. An audio conferencing system comprising:

an adaptive beamforming module with a beamforming adaptivity and a beamforming adaptation state, wherein the adaptive beamforming module is configured to receive a plurality of input audio signals and to generate a beamformed audio signal based upon a combination of the plurality of input audio signals;

an adaptive acoustic echo cancellation module with an AEC adaptivity and an AEC adaptation state, wherein the adaptive acoustic echo cancellation module is configured to receive the beamformed audio signal and to generate an echo-cancelled audio signal based upon the beamformed audio signal and a far-end audio signal; and wherein the adaptive beamforming module is configured to modify the beamforming adaptivity when the AEC adaptation state is unsettled and is configured to restore the beamforming adaptivity when the AEC adaptation state is settled;

wherein the adaptive acoustic echo cancellation module is configured to modify the AEC adaptivity when the beamforming adaptation state is unsettled and is configured to restore the AEC adaptivity when the beamforming adaptation state is settled.

B1.1. The audio conferencing system of paragraph B1, wherein the adaptive beamforming module is configured to reduce the beamforming adaptivity when the AEC adaptation state is unsettled.

B1.2. The audio conferencing system of any of paragraphs B1-B1.1, wherein the adaptive beamforming module is configured to increase the beamforming adaptivity when the AEC adaptation state is unsettled.

B1.3. The audio conferencing system of any of paragraphs B1-B1.2, wherein the adaptive acoustic echo cancellation module is configured to reduce the AEC adaptivity when the beamforming adaptation state is unsettled.

B1.4. The audio conferencing system of any of paragraphs B1-B1.3, wherein the adaptive acoustic echo cancellation module is configured to increase the AEC adaptivity when the beamforming adaptation state is unsettled.

B2. The audio conferencing system of any of paragraphs B1-B1.4, wherein the adaptive beamforming module is configured to provide at least one beamforming status indicator that indicates the beamforming adaptation state;

wherein the adaptive acoustic echo cancellation module is configured to provide at least one AEC status indicator that indicates the AEC adaptation state;

wherein the adaptive beamforming module is configured to receive the AEC status indicator; and wherein the adaptive acoustic echo cancellation module is configured to receive the beamforming status indicator.

B2.1. The audio conferencing system of paragraph B2, wherein the adaptive beamforming module is configured to generate the beamformed audio signal additionally based upon the AEC status indicator.

B2.2. The audio conferencing system of any of paragraphs B2-B2.1, wherein the adaptive acoustic echo cancellation module is configured to generate the echo-cancelled audio signal additionally based upon the beamforming status indicator.

B2.3. The audio conferencing system of any of paragraphs B2-B2.2, wherein the adaptive beamforming module is configured to determine at least one beamforming adaptation parameter based upon the AEC status indicator, wherein the adaptive beamforming module is configured to generate the beamformed audio signal additionally based upon the beamforming adaptation parameter.

B2.3.1. The audio conferencing system of paragraph B2.3, wherein the beamforming adaptation parameter is a beamforming modified-adaptation parameter when the AEC status indicator indicates that the adaptive acoustic echo cancellation module is adapting to changed conditions.

B2.3.1.1. The audio conferencing system of paragraph B2.3.1, wherein the adaptive beamforming module is configured to operate with modified adaptivity in response to the beamforming modified-adaptation parameter.

B2.3.1.2. The audio conferencing system of any of paragraphs B2.3.1-B2.3.1.1, wherein the beamforming modified-adaptation parameter is a beamforming reduced-adaptation parameter and optionally wherein the adaptive beamforming module is configured to operate with reduced adaptivity in response to the beamforming reduced-adaptation parameter.

B2.3.1.3. The audio conferencing system of any of paragraphs B2.3.1-B2.3.1.2, wherein the beamforming modified-adaptation parameter is a beamforming increased-adaptation parameter and optionally wherein the adaptive beamforming module is configured to operate with increased adaptivity in response to the beamforming increased-adaptation parameter.

B2.3.2. The audio conferencing system of any of paragraphs B2.3-B2.3.1.3, wherein the beamforming adaptation parameter is a beamforming nominal-adaptation parameter when the AEC status indicator indicates that the adaptive acoustic echo cancellation module is adapted to changed conditions.

B2.3.2.1. The audio conferencing system of paragraph B2.3.2, wherein the adaptive beamforming module is configured to operate with nominal adaptivity in response to the beamforming nominal-adaptation parameter.

B2.4. The audio conferencing system of any of paragraphs B2.3-B2.3.2.1, wherein the adaptive acoustic echo cancellation module is configured to determine at least one AEC adaptation parameter based upon the beamforming status indicator, wherein the adaptive acoustic echo cancellation module is configured to generate the echo-cancelled audio signal additionally based upon the AEC adaptation parameter.

B2.4.1. The audio conferencing system of paragraph B2.4, wherein the AEC adaptation parameter is an AEC modified-adaptation parameter when the beamforming status indicator indicates that the adaptive beamforming module is adapting to changed conditions.

B2.4.1.1. The audio conferencing system of paragraph B2.4.1, wherein the adaptive acoustic echo cancellation module is configured to operate with modified adaptivity in response to the AEC modified-adaptation parameter.

B2.4.1.2. The audio conferencing system of any of paragraphs B2.4.1-B2.4.1.1, wherein the AEC modified-adaptation parameter is an AEC reduced-adaptation parameter and optionally wherein the adaptive acoustic echo cancellation module is configured to operate with reduced adaptivity in response to the AEC reduced-adaptation parameter.

B2.4.1.3. The audio conferencing system of any of paragraphs B2.4.1-B2.4.1.2, wherein the AEC modified-adaptation parameter is an AEC increased-adaptation parameter and optionally wherein the adaptive acoustic echo cancellation module is configured to operate with increased adaptivity in response to the AEC increased-adaptation parameter.

B2.4.2. The audio conferencing system of any of paragraphs B2.4-B2.4.1.3, wherein the AEC adaptation parameter is an AEC nominal-adaptation parameter when the beamforming status indicator indicates that the adaptive beamforming module is adapted to changed conditions.

B2.4.2.1. The audio conferencing system of paragraph B2.4.2, wherein the adaptive acoustic echo cancellation module is configured to operate with nominal adaptivity in response to the AEC nominal-adaptation parameter.

B3. The audio conferencing system of any of paragraphs B1-B2.4.2.1, further comprising a plurality of microphones.

B4. The audio conferencing system of any of paragraphs B1-B3, further comprising a loudspeaker.

B5. The audio conferencing system of any of paragraphs B1-B4, further comprising an audio activity detector.

B6. The audio conferencing system of any of paragraphs B1-B5, wherein the adaptive beamforming module, where used, is an adaptive mixer module and wherein the beamformed audio signal, where used, is a mixed audio signal.

B7. The audio conferencing system of any of paragraphs B1-B6, wherein the adaptive beamforming module, where used, is an adaptive signal combination module and wherein the beamformed audio signal, where used, is a combined audio signal.

B8. The audio conferencing system of any of paragraphs B1-B7, wherein any one or more of the adaptive beamforming module, the adaptive acoustic echo cancellation module, the beamforming status indicator, the AEC status indicator, the beamforming adaptation parameter, the AEC adaptation parameter, the input audio signals, the beamformed audio signal, the echo-cancelled audio signal, the far-end audio signal, the plurality of microphones, the loudspeaker, and/or the audio activity detector is the respective element of any of paragraphs A1-A17.

C1. A method of combined beamforming and acoustic echo cancellation, the method comprising:

receiving at least one AEC status indicator from an adaptive acoustic echo cancellation module;

determining a beamforming adaptation parameter based upon the AEC status indicator;

beamforming a plurality of input audio signals into a beamformed audio signal based upon the beamforming adaptation parameter using an adaptive beamforming module;

receiving at least one beamforming status indicator from the adaptive beamforming module;

determining an AEC adaptation parameter based upon the beamforming status indicator;

echo-cancelling the beamformed audio signal to generate an echo-cancelled audio signal based upon the AEC adaptation parameter using the adaptive acoustic echo cancellation module.

C2. The method of paragraph C1, wherein any one or more of the adaptive beamforming module, the adaptive acoustic echo cancellation module, the beamforming status indicator, the AEC status indicator, the beamforming adaptation parameter, the AEC adaptation parameter, the input audio signals, the beamformed audio signal, and/or the echo-cancelled audio signal is the respective element of any of paragraphs A1-A17.

C3. A computer-readable medium that includes instructions that, when executed by one or more processors, performs the method of any of paragraphs C1-02.

D1. A method of combined beamforming and acoustic echo cancellation in an audio conferencing system that includes an adaptive beamforming module and an adaptive acoustic echo cancellation module, the method comprising:

receiving a first AEC status indicator from the adaptive acoustic echo cancellation module that indicates that the adaptive acoustic echo cancellation module is adapting to changed conditions;

determining a beamforming modified-adaptation parameter based upon the first AEC status indicator;

while the adaptive acoustic echo cancellation module is adapting to changed conditions as indicated by the first AEC status indicator, beamforming with the adaptive beamforming module based upon the beamforming modified-adaptation parameter;

receiving a first beamforming status indicator from the adaptive beamforming module that indicates that the adaptive beamforming module is adapting to changed conditions;

determining an AEC modified-adaptation parameter based upon the first beamforming status indicator; and while the adaptive beamforming module is adapting to changed conditions as indicated by the first beamforming status indicator, echo-cancelling with the adaptive acoustic echo cancellation module based upon the AEC modified-adaptation parameter.

D1.1. The method of paragraph D1, wherein the beamforming modified-adaptation parameter is a beamforming reduced-adaptation parameter.

D1.2. The method of any of paragraphs D1-D1.1, wherein the beamforming modified-adaptation parameter is a beamforming increased-adaptation parameter.

D1.3. The method of any of paragraphs D1-D1.2, wherein the AEC modified-adaptation parameter is an AEC reduced-adaptation parameter.

D1.4. The method of any of paragraphs D1-D1.3, wherein the AEC modified-adaptation parameter is an AEC increased-adaptation parameter.

D2. The method of any of paragraphs D1-D1.4, wherein the first AEC status indicator indicates that the adaptive acoustic echo cancellation module is in an unsettled state.

D3. The method of any of paragraphs D1-D2, wherein the first beamforming status indicator indicates that the adaptive beamforming module is in an unsettled state.

D4. The method of any of paragraphs D1-D3, further comprising:

receiving a second AEC status indicator from the adaptive acoustic echo cancellation module that indicates that the adaptive acoustic echo cancellation module is adapted to changed conditions;

determining a beamforming nominal-adaptation parameter based upon the second AEC status indicator;

while the adaptive acoustic echo cancellation module is adapted to changed conditions as indicated by the second AEC status indicator, beamforming with the adaptive beamforming module based upon the beamforming nominal-adaptation parameter;

receiving a second beamforming status indicator from the adaptive beamforming module that indicates that the adaptive beamforming module is adapted to changed conditions;

determining an AEC nominal-adaptation parameter based upon the second beamforming status indicator; and while the adaptive beamforming module is adapted to changed conditions as indicated by the second beamforming status indicator, echo-cancelling with the adaptive acoustic echo cancellation module based upon the AEC nominal-adaptation parameter.

D4.1. The method of paragraph D4, wherein the second AEC status indicator indicates that the adaptive acoustic echo cancellation module is in a settled state.

D4.2. The method of any of paragraphs D4-D4.1, wherein the second beamforming status indicator indicates that the adaptive beamforming module is in a settled state.

D4.3. The method of any of paragraphs D4-D4.2, wherein beamforming with the adaptive beamforming module based upon the beamforming modified-adaptation parameter is beamforming with reduced adaptivity relative to beamforming with the adaptive beamforming module based upon the beamforming nominal-adaptation parameter.

D4.4. The method of any of paragraphs D4-D4.3, wherein beamforming with the adaptive beamforming module based upon the beamforming modified-adaptation parameter is beamforming with increased adaptivity relative to beamforming with the adaptive beamforming module based upon the beamforming nominal-adaptation parameter.

D4.5. The method of any of paragraphs D4-D4.4, wherein echo-cancelling with the adaptive acoustic echo cancellation module based upon the AEC modified-adaptation parameter is echo-cancelling with reduced adaptivity relative to echo-cancelling with the adaptive acoustic echo cancellation module based upon the AEC nominal-adaptation parameter.

D4.6. The method of any of paragraphs D4-D4.5, wherein echo-cancelling with the adaptive acoustic echo cancellation module based upon the AEC modified-adaptation parameter is echo-cancelling with increased adaptivity relative to echo-cancelling with the adaptive acoustic echo cancellation module based upon the AEC nominal-adaptation parameter.

D4.7. The method of any of paragraphs D4-D4.6, further comprising:

detecting far-end single-talk activity;

during far-end single-talk activity, beamforming with the adaptive beamforming module based upon a first beamforming modified-adaptation parameter and echo-cancelling with the adaptive acoustic echo cancellation module based upon the AEC nominal-adaptation parameter;

detecting near-end single-talk activity;

during near-end single-talk activity, beamforming with the adaptive beamforming module based upon the beamforming nominal-adaptation parameter and echo-cancelling with the adaptive acoustic echo cancellation module based upon a first AEC modified-adaptation parameter;

detecting double-talk activity;

during double-talk activity, while the adaptive acoustic echo cancellation module is adapting to changed conditions, beamforming with the adaptive beamforming module based upon a second beamforming modified-adaptation parameter, and while the adaptive acoustic echo cancellation module is adapted to changed conditions, (i) beamforming with the adaptive beamforming module based upon the beamforming nominal-adaptation parameter, (ii) while the adaptive beamforming module is adapted to changed conditions, echo-cancelling with the adaptive acoustic echo cancellation module based upon the AEC nominal-adaptation parameter, and (iii) while the adaptive beamforming module is adapting to changed conditions, echo-cancelling with the adaptive acoustic echo cancellation module based upon a second AEC modified-adaptation parameter.

D4.7.1. The method of paragraph D4.7, wherein the far-end single-talk activity is far-end voice activity and no significant near-end voice activity.

D4.7.2. The method of any of paragraphs D4.7-D4.7.1, wherein the near-end single-talk activity is near-end voice activity and no significant far-end voice activity.

D4.7.3. The method of any of paragraphs D4.7-D4.7.2, wherein the first beamforming modified-adaptation parameter is a/the beamforming reduced-adaptation parameter and the second beamforming modified-adaptation parameter is the beamforming reduced-adaptation parameter.

D4.7.4. The method of any of paragraphs D4.7-D4.7.3, wherein the first AEC modified-adaptation parameter is an/the AEC reduced-adaptation parameter and the second AEC modified-adaptation parameter is an/the AEC increased-adaptation parameter.

D5. The method of any of paragraphs D1-D4.7.4, wherein any one or more of the adaptive beamforming module, the adaptive acoustic echo cancellation module, the (first and second) beamforming status indicators, the (first and second) AEC status indicators, the (first and second) beamforming (modified and nominal) adaptation parameters, and/or the (first and second) AEC (modified and nominal) adaptation parameters is the respective element of any of paragraphs A1-A17.

D6. A computer-readable medium that includes instructions that, when executed by one or more processors, performs the method of any of paragraphs D1-D5.

E1. A method of combined beamforming and acoustic echo cancellation in an audio conferencing system that includes an adaptive beamforming module and an adaptive acoustic echo cancellation module, wherein the adaptive beamforming module is configured to operate with at least one of a beamforming nominal adaptivity and a beamforming modified adaptivity, and wherein the adaptive acoustic echo cancellation module is configured to operate with at least one of an AEC nominal adaptivity and an AEC modified adaptivity:

receiving a first AEC status indicator from the adaptive acoustic echo cancellation module that indicates that the adaptive acoustic echo cancellation module is adapting to changed conditions;

while the adaptive acoustic echo cancellation module is adapting to changed conditions as indicated by the first AEC status indicator, beamforming with the adaptive beamforming module at the beamforming modified adaptivity;

receiving a first beamforming status indicator from the adaptive beamforming module that indicates that the adaptive beamforming module is adapting to changed conditions; and while the adaptive beamforming module is adapting to changed conditions as indicated by the first beamforming status indicator, echo-cancelling with the adaptive acoustic echo cancellation module at the AEC modified adaptivity.

E1.1. The method of paragraph E1, wherein the beamforming modified adaptivity is a beamforming reduced adaptivity.

E1.2. The method of any of paragraphs E1-E1.1, wherein the beamforming modified adaptivity is a beamforming increased adaptivity.

E1.3. The method of any of paragraphs E1-E1.2, wherein the AEC modified adaptivity is an AEC reduced adaptivity.

E1.4. The method of any of paragraphs E1-E1.3, wherein the AEC modified adaptivity is an AEC increased adaptivity.

E2. The method of any of paragraphs E1-E1.4, wherein the first AEC status indicator indicates that the adaptive acoustic echo cancellation module is in an unsettled state.

E3. The method of any of paragraphs E1-E2, wherein the first beamforming status indicator indicates that the adaptive beamforming module is in an unsettled state.

E4. The method of any of paragraphs E1-E3, further comprising:

receiving a second AEC status indicator from the adaptive acoustic echo cancellation module that indicates that the adaptive acoustic echo cancellation module is adapted to changed conditions;

while the adaptive acoustic echo cancellation module is adapted to changed conditions as indicated by the second AEC status indicator, beamforming with the adaptive beamforming module at the beamforming nominal adaptivity;

receiving a second beamforming status indicator from the adaptive beamforming module that indicates that the adaptive beamforming module is adapted to changed conditions; and while the adaptive beamforming module is adapted to changed conditions as indicated by the second beamforming status indicator, echo-cancelling with the adaptive acoustic echo cancellation module at the AEC nominal adaptivity.

E4.1. The method of paragraph E4, wherein the second AEC status indicator indicates that the adaptive acoustic echo cancellation module is in a settled state.

E4.2. The method of any of paragraphs E4-E4.1, wherein the second beamforming status indicator indicates that the adaptive beamforming module is in a settled state.

E4.3. The method of any of paragraphs E4-E4.2, further comprising:

detecting far-end single-talk activity;

during far-end single-talk activity, beamforming with the adaptive beamforming module at a first beamforming modified adaptivity and echo-cancelling with the adaptive acoustic echo cancellation module at the AEC nominal adaptivity;

detecting near-end single-talk activity;

during near-end single-talk activity, beamforming with the adaptive beamforming module at the beamforming nominal adaptivity and echo-cancelling with the adaptive acoustic echo cancellation module at a first AEC modified adaptivity;

detecting double-talk activity;

during double-talk activity, while the adaptive acoustic echo cancellation module is adapting to changed conditions, beamforming with the adaptive beamforming module at a second beamforming modified adaptivity, and while the adaptive acoustic echo cancellation module is adapted to changed conditions, (i) beamforming with the adaptive beamforming module at the beamforming nominal adaptivity, (ii) while the adaptive beamforming module is adapted to changed conditions, echo-cancelling with the adaptive acoustic echo cancellation module at the AEC nominal adaptivity, and (iii) while the adaptive beamforming module is adapting to changed conditions, echo-cancelling with the adaptive acoustic echo cancellation module at a second AEC modified adaptivity.

E4.3.1. The method of paragraph E4.3, wherein the far-end single-talk activity is far-end voice activity and no significant near-end voice activity.

E4.3.2. The method of any of paragraphs E4.3-E4.3.1, wherein the near-end single-talk activity is near-end voice activity and no significant far-end voice activity.

E4.3.3. The method of any of paragraphs E4.3-E4.3.2, wherein the first beamforming modified adaptivity is a/the beamforming reduced adaptivity and the second beamforming modified adaptivity is the beamforming reduced adaptivity.

E4.3.4. The method of any of paragraphs E4.3-E4.3.3, wherein the first AEC modified adaptivity is an/the AEC reduced adaptivity and the second AEC modified adaptivity is an/the AEC increased adaptivity.

E5. The method of any of paragraphs E1-E4.3.4, wherein any one or more of the adaptive beamforming module, the adaptive acoustic echo cancellation module, the (first and second) beamforming status indicator, the (first and second) AEC status indicator, the (first and second) beamforming (modified and nominal) adaptivity, and/or the (first and second) AEC (modified and nominal) adaptivity is the respective element of any of paragraphs A1-A17.

E6. A computer-readable medium that includes instructions that, when executed by one or more processors, performs the method of any of paragraphs E1-E5.

As used herein, the term "configured" means that the element, component, or other subject matter is designed, programmed, and/or intended to perform a given function. Thus, the use of the term "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being configured to perform a particular function may additionally or alternatively be described as being operative to perform that function and/or as implementing logic that, when executed by one or more processors, performs that function.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, the phrases "at least one of" and "one or more of," in reference to a list of more than one entity, means any one or more of the entities in the list of entities, and is not limited to at least one of each and every entity specifically listed within the list of entities. For example, "at least one of A and B" (or, equivalently, "at least one of A or B," or, equivalently, "at least one of A and/or B") may refer to A alone, B alone, or the combination of A and B.

As used herein, the singular forms "a", "an" and "the" may be intended to include the plural forms as well, unless the context clearly indicates otherwise.

The various disclosed elements of systems and steps of methods disclosed herein are not required of all systems and methods according to the present disclosure, and the present disclosure includes all novel and non-obvious combinations and subcombinations of the various elements and steps disclosed herein. Moreover, any of the various elements and steps, or any combination of the various elements and/or steps, disclosed herein may define independent inventive subject matter that is separate and apart from the whole of a disclosed system or method. Accordingly, such inventive subject matter is not required to be associated with the specific systems and methods that are expressly disclosed herein, and such inventive subject matter may find utility in systems and/or methods that are not expressly disclosed herein.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. An audio conferencing system comprising:

an adaptive beamforming module with a beamforming adaptivity and a beamforming adaptation state, wherein the adaptive beamforming module is configured to receive one or more beamforming adaptation parameters to control the beamforming adaptivity and is configured to provide one or more beamforming status indicators that indicate the beamforming adaptation state, and wherein the adaptive beamforming module is configured to receive a plurality of input audio signals and to generate a beamformed audio signal based upon the beamforming adaptation parameters and a combination of the plurality of input audio signals;

an adaptive acoustic echo cancellation module with an acoustic echo cancellation (AEC) adaptivity and an AEC adaptation state, wherein the adaptive acoustic echo cancellation module is configured to receive one or more AEC adaptation parameters to control the AEC adaptivity and is configured to provide one or more AEC status indicators that indicate the AEC adaptation state, and wherein the adaptive acoustic echo cancellation module is configured to receive the beamformed audio signal and to generate an echo-cancelled audio signal based upon the AEC adaptation parameters, the beamformed audio signal, and a far-end audio signal; and an adaptation control module that is configured to reduce the beamforming adaptivity when the AEC adaptation state is unsettled, to increase the AEC adaptivity when the beamforming adaptation state is unsettled, to restore the beamforming adaptivity when the AEC adaptation state is settled, and to restore the AEC adaptivity when the beamforming adaptation state is settled;

wherein the adaptive beamforming module includes a tracking beamformer and wherein one of the beamforming adaptation parameters is an update rate of the tracking beamformer.

2. The audio conferencing system of claim 1, wherein the adaptive beamforming module includes an adaptive beam combiner and wherein one of the beamforming adaptation parameters is a mixer time constant of the adaptive beam combiner.

3. The audio conferencing system of claim 1, wherein one of the beamforming adaptation parameters includes at least one of a beam selectivity, a beam directivity, a beam size, and a target beam signal to noise ratio.

4. The audio conferencing system of claim 1, wherein one of the beamforming status indicators indicates a location related to at least one of the plurality of input audio signals.

5. The audio conferencing system of claim 1, wherein the adaptive acoustic echo cancellation module includes a primary echo removal filter and wherein one of the AEC adaptation parameters is a convergence rate of the primary echo removal filter.

6. The audio conferencing system of claim 1, wherein one of the AEC adaptation parameters includes at least one of a target echo return loss enhancement, a target combined echo loss, and a target residual echo signal level.

7. The audio conferencing system of claim 1, wherein the adaptive acoustic echo cancellation module includes an adaptive primary echo removal filter and a residual and noise removal post-filter, and wherein one of the AEC adaptation parameters affects a relative contribution of the adaptive primary echo removal filter and the residual and noise removal post-filter to the echo-cancelled audio signal.

8. The audio conferencing system of claim 1, wherein one of the AEC status indicators includes at least one of a near-end voice activity, a double-talk activity, and a near-end noise activity.

9. The audio conferencing system of claim 1, further comprising:

a plurality of microphones that is configured to transmit the plurality of input audio signals based upon sound received at the microphones from a reception space; and a loudspeaker configured to render sound according to the far-end audio signal into the reception space.

10. An audio conferencing system comprising:

an adaptive beamforming module with a beamforming adaptivity and a beamforming adaptation state, wherein the adaptive beamforming module is configured to provide one or more beamforming status indicators that indicate the beamforming adaptation state, and wherein the adaptive beamforming module is configured to receive a plurality of input audio signals and to generate a beamformed audio signal based upon a combination of the plurality of input audio signals;

an adaptive acoustic echo cancellation module with an acoustic echo cancellation (AEC) adaptivity and an AEC adaptation state, wherein the adaptive acoustic echo cancellation module is configured to provide one or more AEC status indicators that indicate the AEC adaptation state, and wherein the adaptive acoustic echo cancellation module is configured to receive the beamformed audio signal and to generate an echo-cancelled audio signal based upon the beamformed audio signal and a far-end audio signal; and wherein the adaptive beamforming module is configured to receive the AEC status indicators, to reduce the beamforming adaptivity when the AEC adaptation state is unsettled, and to restore the beamforming adaptivity when the AEC adaptation state is settled;

wherein the adaptive acoustic echo cancellation module is configured to receive the beamforming status indicators, to increase the AEC adaptivity when the beamforming adaptation state is unsettled, and to restore the AEC adaptivity when the beamforming adaptation state is settled;

wherein the adaptive acoustic echo cancellation module is configured to determine one or more AEC adaptation parameters based upon the beamforming status indicators, wherein the adaptive acoustic echo cancellation module is configured to generate the echo-cancelled audio signal additionally based upon the AEC adaptation parameters;

wherein the adaptive acoustic echo cancellation module includes a primary echo removal filter and wherein one of the AEC adaptation parameters is a convergence rate of the primary echo removal filter.

11. The audio conferencing system of claim 10, wherein the adaptive beamforming module is configured to determine one or more beamforming adaptation parameters based upon the AEC status indicators, wherein the adaptive beamforming module is configured to generate the beamformed audio signal additionally based upon the beamforming adaptation parameters.

12. A method of combined beamforming and acoustic echo cancellation in an audio conferencing system that includes an adaptive beamforming module and an adaptive acoustic echo cancellation module, the method comprising:

receiving a first acoustic echo cancellation (AEC) status indicator from the adaptive acoustic echo cancellation module that indicates that the adaptive acoustic echo cancellation module is adapting to changed conditions;

determining a beamforming modified-adaptation parameter based upon the first AEC status indicator;

while the adaptive acoustic echo cancellation module is adapting to changed conditions as indicated by the first AEC status indicator, beamforming with the adaptive beamforming module based upon the beamforming modified-adaptation parameter;

receiving a first beamforming status indicator from the adaptive beamforming module that indicates that the adaptive beamforming module is adapting to changed conditions;

determining an AEC modified-adaptation parameter based upon the first beamforming status indicator;

while the adaptive beamforming module is adapting to changed conditions as indicated by the first beamforming status indicator, echo-cancelling with the adaptive acoustic echo cancellation module based upon the AEC modified-adaptation parameter;

receiving a second AEC status indicator from the adaptive acoustic echo cancellation module that indicates that the adaptive acoustic echo cancellation module is adapted to changed conditions;

determining a beamforming nominal-adaptation parameter based upon the second AEC status indicator;

while the adaptive acoustic echo cancellation module is adapted to changed conditions as indicated by the second AEC status indicator, beamforming with the adaptive beamforming module based upon the beamforming nominal-adaptation parameter;

receiving a second beamforming status indicator from the adaptive beamforming module that indicates that the adaptive beamforming module is adapted to changed conditions;

determining an AEC nominal-adaptation parameter based upon the second beamforming status indicator; and while the adaptive beamforming module is adapted to changed conditions as indicated by the second beamforming status indicator, echo-cancelling with the adaptive acoustic echo cancellation module based upon the AEC nominal-adaptation parameter.

13. The method of claim 12, wherein the first AEC status indicator indicates that the adaptive acoustic echo cancellation module is in an unsettled state and wherein the first beamforming status indicator indicates that the adaptive beamforming module is in an unsettled state.

14. The method of claim 12, wherein the second AEC status indicator indicates that the adaptive acoustic echo cancellation module is in a settled state and wherein the second beamforming status indicator indicates that the adaptive beamforming module is in a settled state.

15. The method of claim 12, further comprising:

detecting far-end single-talk activity;

during far-end single-talk activity, beamforming with the adaptive beamforming module based upon a beamforming reduced-adaptation parameter and echo-cancelling with the adaptive acoustic echo cancellation module based upon the AEC nominal-adaptation parameter, wherein the beamforming reduced-adaptation parameter is the beamforming modified-adaptation parameter;

detecting near-end single-talk activity;

during near-end single-talk activity, beamforming with the adaptive beamforming module based upon the beamforming nominal-adaptation parameter and echo-cancelling with the adaptive acoustic echo cancellation module based upon an AEC reduced-adaptation parameter;

detecting double-talk activity;

during double-talk activity, while the adaptive acoustic echo cancellation module is adapting to changed conditions, beamforming with the adaptive beamforming module based upon the beamforming reduced-adaptation parameter, and while the adaptive acoustic echo cancellation module is adapted to changed conditions, (i) beamforming with the adaptive beamforming module based upon the beamforming nominal-adaptation parameter, (ii) while the adaptive beamforming module is adapted to changed conditions, echo-cancelling with the adaptive acoustic echo cancellation module based upon the AEC nominal-adaptation parameter, and (iii) while the adaptive beamforming module is adapting to changed conditions, echo-cancelling with the adaptive acoustic echo cancellation module based upon the AEC modified-adaptation parameter, wherein the AEC modified-adaptation parameter is an AEC increased-adaptation parameter.

16. The audio conferencing system of claim 11, wherein the adaptive beamforming module includes a tracking beamformer and wherein one of the beamforming adaptation parameters is an update rate of the tracking beamformer.

17. The audio conferencing system of claim 11, wherein the adaptive beamforming module includes an adaptive beam combiner and wherein one of the beamforming adaptation parameters is a mixer time constant of the adaptive beam combiner.

18. The audio conferencing system of claim 11, wherein one of the beamforming adaptation parameters includes at least one of a beam selectivity, a beam directivity, a beam size, and a target beam signal to noise ratio.

19. The audio conferencing system of claim 10, wherein one of the AEC adaptation parameters includes at least one of a target echo return loss enhancement, a target combined echo loss, and a target residual echo signal level.

20. The audio conferencing system of claim 10, wherein the adaptive acoustic echo cancellation module includes an adaptive primary echo removal filter and a residual and noise removal post-filter, and wherein one of the AEC adaptation parameters affects a relative contribution of the adaptive primary echo removal filter and the residual and noise removal post-filter to the echo-cancelled audio signal.

* * * * *